US009512656B2

(12) United States Patent
Lee

(10) Patent No.: US 9,512,656 B2
(45) Date of Patent: Dec. 6, 2016

(54) SLIDING WINDOW INSTALLATION STRUCTURE INCLUDING DOOR GUIDE FRAME HAVING SEPARABLE SEGMENT STRUCTURE

(71) Applicant: Filobe Co., Ltd., Daegu (KR)

(72) Inventor: Kwang-Seok Lee, Daegu (KR)

(73) Assignee: FILOBE CO., LTD, Daegu (KR)

( * ) Notice: Subject to any disclaimer, the term of this patent is extended or adjusted under 35 U.S.C. 154(b) by 0 days.

(21) Appl. No.: 14/398,779

(22) PCT Filed: May 6, 2013

(86) PCT No.: PCT/KR2013/003912
§ 371 (c)(1),
(2) Date: Nov. 4, 2014

(87) PCT Pub. No.: WO2013/168943
PCT Pub. Date: Nov. 14, 2013

(65) Prior Publication Data

US 2015/0121764 A1 May 7, 2015

(30) Foreign Application Priority Data

May 6, 2012 (KR) ..... 10-2012-0047789

(51) Int. Cl.
*E05D 15/06* (2006.01)
*E05D 15/48* (2006.01)
(Continued)

(52) U.S. Cl.
CPC ..... *E05D 15/0678* (2013.01); *E05D 15/0621* (2013.01); *E05D 15/0665* (2013.01);
(Continued)

(58) Field of Classification Search
CPC .. E05D 15/0678; E05D 15/0621; E05D 15/48; E05D 15/0686; E05D 15/0665; E05D 15/0682; E06B 7/22; E06B 3/46; E06B 3/4609; E06B 2003/5463
(Continued)

(56) References Cited

U.S. PATENT DOCUMENTS 1,731,659 A * 10/1929 Greitzer ..... 16/100
2,865,061 A * 12/1958 Kunkel ..... 49/188
(Continued)

*Primary Examiner* — Justin Rephann
(74) *Attorney, Agent, or Firm* — Neifeld IP Law, PC

(57) ABSTRACT

The present invention relates to a door guide frame for guiding the sliding movement of a roller device which supports a sliding window and provides a sliding opening/closing operation and, more specifically, to a sliding window installation structure which: stably supports and moves a sliding window on a bottom surface and an upper surface on which the sliding window is installed; reduces an installation space by minimizing the size of a door guide frame and a roller device for supporting a heavy sliding window, thereby obtaining a wider open view when applied to a window; enables vertical stiffeners having an expanded cross section (cross section thicker than glass) for compensating a transverse bending rigidity of glass to be connected to both sides of the glass which constitutes the sliding window formed by including the glass that is supported by a roller; and enables the sliding window with the vertical stiffeners to be installed within the door guide frame in an integrated manner and the sliding window to be detached from the door guide frame in which the sliding window includes the vertical stiffeners.

15 Claims, 36 Drawing Sheets

(51) Int. Cl.

| | |
|---|---|
| ***E06B 7/22*** | (2006.01) |
| ***E06B 3/46*** | (2006.01) |
| ***E06B 3/263*** | (2006.01) |
| *E06B 3/54* | (2006.01) |

(52) U.S. Cl.
CPC ..... *E05D 15/0682* (2013.01); *E05D 15/0686* (2013.01); *E05D 15/48* (2013.01); *E06B 3/26347* (2013.01); *E06B 3/46* (2013.01); *E06B 3/4609* (2013.01); *E06B 7/22* (2013.01); *E05Y 2600/56* (2013.01); *E05Y 2800/406* (2013.01); *E05Y 2900/148* (2013.01); *E06B 3/4681* (2013.01); *E06B 2003/5463* (2013.01)

(58) Field of Classification Search
USPC ..... 49/194, 404, 411, 413, 420, 421, 423,49/425, 431, 463, 464, 466
See application file for complete search history.

(56) References Cited

U.S. PATENT DOCUMENTS

| | | | | |
|---|---|---|---|---|
| 3,584,417 | A * | 6/1971 | Gatton et al. | 49/404 |
| 4,881,768 | A * | 11/1989 | Lange | 292/251 |
| 5,884,361 | A * | 3/1999 | Richardson et al. | 16/100 |
| 7,024,820 | B1 * | 4/2006 | Dustin | 49/168 |
| 7,555,871 | B1 * | 7/2009 | Neal | 52/204.51 |
| 2008/0190030 | A1 * | 8/2008 | Cheon et al. | 49/425 |
| 2009/0038228 | A1 * | 2/2009 | Lee | 49/360 |
| 2010/0115877 | A1 * | 5/2010 | Yoo et al. | 52/656.2 |
| 2010/0242365 | A1 * | 9/2010 | Langner et al. | 49/130 |
| 2013/0008089 | A1 * | 1/2013 | Mancebo | 49/413 |
| 2013/0255156 | A1 * | 10/2013 | Snider | 49/130 |
| 2015/0052819 | A1 * | 2/2015 | Lee | 49/420 |

* cited by examiner

Comparative Example A

SLIDING WINDOW INSTALLATION STRUCTURE INCLUDING DOOR GUIDE FRAME HAVING SEPARABLE SEGMENT STRUCTURE

CROSS REFERENCE TO RELATED APPLICATIONS

This application is a national stage entry of PCT/KR2013/003912, May 6, 2013, which published as WO 2013/168943 in a language other than English on Nov. 14, 2013, which claims priority to Korean Application No. 10-2012-0047789, filed May 6, 2012.

TECHNICAL FIELD

The present invention relates to a door guide frame for guiding the sliding movement of a roller device which supports a sliding window and provides a sliding opening/closing operation and, more particularly, to a sliding window installation structure which is capable of: stably supporting and moving a sliding window or a horizontal sliding window (hereinafter, generally referred to as a "sliding window") on a bottom surface and a top surface on which the sliding window is installed; reducing an installation space by minimizing the size of a door guide frame and a roller device for supporting a heavy sliding window, thereby obtaining a wider open view when applied to a window; and employing a structure which prevents a door guide rail from protruding upward from the bottom surface of a window frame so as to prevent occurrence of a passage obstacle which may be caused when the door guide rail protrudes on a moving passage while the window is opened, as well as to provide a good aesthetic appearance, thereby providing excellent applicability to various fields.

BACKGROUND ART

In general, according to conventional configurations of a door sash (which is configured to install a window glass panel therein and hereinafter, will be described with reference to a door provided with a glass panel, i.e. a window) and a door guide frame (which is installed on a wall surface, a bottom surface, a ceiling surface, or the like so that the door sash is installed inside the door guide frame to be slidingly guided and thus opened/closed) which constitute a sliding window system which is most commonly used as a window system in most of buildings in consideration of cost reduction including efficiency of an opening/closing space and easy installation, as illustrated in FIGS. 1 and 2, a roller guide rail 1*a* is provided on the door guide frame 1 (also referred to as a "window frame"), and a roller 4*r* is installed on a lower part of the door sashes 4*a* and 4*b* in which a glass panel 4*g* is put, thereby providing a structure in which a sliding window 4 is slid along the roller guide rail 1*a*.

In such a structure, the roller 4*r* below a lower door sash 4*a* is slid while supporting the weight of the sliding window 4 on the roller guide rail 1*a*, and a sliding guide recess formed on an upper door sash 4*b* is guided along an upper guide rail 1*b* installed on the upper surface of the window frame 1 while supporting the upper end of the sliding window 4 so that the sliding window 4 may be smoothly moved to be opened/closed while being prevented from falling down.

In the above described sliding window system having the conventional structure of the prior art as illustrated in FIGS. 1 and 2, since the door sashes 4*a* and 4*b* supporting the glass panel 4*g* are configured to support the four sides of the glass panel 4*g*, it is impossible to secure a wide open view due to the interference of the door sashes 4*a* and 4*b*. Therefore, as an alternative structure for this, recently, the phenomenon of reducing the open view through the sliding window 4 due to the door sashes 4*a* and 4*b* illustrated in FIGS. 1 and 2 described above is minimized by adopting the following structure: a sliding window 4 is configured by placing the glass panel 4*g* directly on a roller 4*r* member without a separate door sash which supports the glass panel 4*g* at the four sides of top and bottom, left and right of the glass panel 4*g*, as illustrated in FIG. 3, and a roller guide rail 1*a* is formed below a door guide frame 1 corresponding to a window frame below the sliding window 4 so that the roller 4*r* below the sliding window 4 slides on the roller guide rail 1*a* while supporting the weight of the sliding window 4. In addition, a downwardly opened upper pocket guide 1*d* is formed on an upper portion 1*b* of the door guide frame 1 corresponding to the window frame along the rail travel direction so as to guide the sliding of both the inner and outer surfaces (front and rear surfaces/inner and outer surfaces) of the upper end of the sliding window 4 in a state where the upper end of the sliding window 4 is accommodated inside of the upper pocket guide 1*d*, thereby supporting the smooth movement of the sliding window above the sliding window 4.

However, in view of the lower support structure on which the glass panel 4*g*, the roller 4*r* below the glass panel 4*g*, and the roller guide rail 1*a* below the roller 4*r* are continuously supported when the sliding window 4 is made only using the glass panel 4*g* without a door sash as described above, when a wind pressure W acts from the outside of the window as illustrated in the right side of FIG. 3, the glass panel 4*g* constituting the sliding window 4 and the upper pocket guide 1*d* provided in a pocket shape in the upper portion 1*b* of the door guide frame 1 has a structure capable of supporting the sliding window 4 even if the wind pressure W acts on the glass panel 4*g*, but no separate structure capable of resisting against a transverse force such as the wind pressure W is provided among the glass panel 4*g* constituting the sliding window 4, the roller 4*r* below the glass panel 4*g*, and the roller guide rail 1*a*. Therefore, the roller 4*r* and the lower portion of the glass panel 4*g* may be overturned (fall down) to a side of the window by the wind pressure.

As a method of solving such a problem, the lower structure of the door guide frame 1 forming the window frame may be improved to provide, on the lower portion of the door guide frame 1, a lower pocket guide 1*c* having a shape symmetric to the pocket-shaped upper pocket guide 1*d* formed on the upper portion 1*b* of the door guide frame 1. That is, as illustrated in FIG. 4, when an upwardly opened lower pocket guide 1*c* is provided along the rail travel direction so as to guide the sliding of the lower end of the glass panel constituting the sliding window 4 on the both inner and outer surfaces (front and rear surface/inner and outer surfaces) of the window, the lower pocket guide 1*c* may prevent the rotated (overturned) displacement of the lower end of the glass panel 4*g* from exceeding a predetermined range even if a strong wind pressure is applied, which may cause the lower end of the glass panel 4*g* and the roller 4*r* supporting the glass panel 4*g* to be overturned on the roller guide rail 1*a*. As a result, a restoring force, which causes the lower end of the glass panel 4*g* and the roller 4*r* supporting the glass panel 4*g* to maintain the vertical state again by the self-weight of the glass panel 4*g*, acts so as to raise the roller 4*r* up to a correct posture again so that the roller 4*r* may return to the original position thereof.

Meanwhile, FIG. 4 illustrates the state where a location where the bottom surface of the lower end of the glass panel 4*g* and the top surface of the upper end of the roller 4*r* does not pass over a vertical center line C.L. of the roller guide rail 1*a* which supports the roller 4*r* (when a positive pressure and a negative pressure are equal to each other, the portions indicated by reference numerals "d1" and "d2" in FIG. 4 may be set to be equal to each other but according to a pressure condition, the portions indicated by reference numerals "d1" and "d2" may be set to be different from each other). Unlike this, however, when excessive overturn is caused so that a location, where the bottom surface of the lower end of the glass panel 4*g* and the top surface of the upper end of the roller 4*r* come in contact with each other to support the glass panel 4*g* (the location indicated by reference numeral "k1" in FIG. 4), passes over the vertical center line C.L. of the lower roller guide rail 1*a*, it is impossible to expect the above-described restoring action. In such a case, the sliding window 4 is slid in the state where the glass panel 4*g* and one side surface of the lower pocket guide 1*c* are in contact with each other, thereby generating frictional noise as well as seriously damaging mobility.

Accordingly, the range of the width of the opening of the lower pocket guide 1*c* should be set such that, even if the lower end of the glass panel 4*g* and the roller 4*r* are overturned, the location, where the bottom surface of the lower end of the glass panel 4*g* and the top surface of the upper end of the roller 4*r* are in contact with each other to the glass panel 4*g* (reference numeral "k1" in FIG. 4), does not pass over the vertical center line C.L. of the lower roller guide rail 1*a*.

In addition, it may be assumed that the location, where the location where the bottom surface of the lower end of the glass panel 4*g* and the top surface of the upper end of the roller 4*r* are in contact with each other to support the glass panel 4*g* as illustrated in FIG. 4 (reference numeral "k1" in FIG. 4), is slid on the top surface of the upper end of the roller 4*r* by itself. When such a phenomenon occurs, it is impossible to expect a satisfactory turnover prevention effect only by controlling the width of the opening of the lower pocket guide 1*c* as described above. Thus, as illustrated in FIG. 5, it may be preferable to provide a glass panel's lower end supporting shoulder 4*c* on the upper end of the support bracket of the roller 4*r* so as to prevent the slipping of the location where the bottom surface of the lower end of the glass panel 4*g* and the top surface of the upper end of the roller 4*r* are in contact with each other to support the glass panel 4*g* (reference numeral "k2" in FIG. 5.

The sliding window with the above-described structure may stably support the sliding of the glass panel and roller while preventing the overturn of the glass panel and the roller in relation to a predetermined level of wind pressure. However, when the sliding window is enlarged as illustrated in FIG. 6 which illustrates a front view of a sliding window system and FIG. 7 which illustrates a cross-section taken along line A-A' in FIG. 6, the vertical length (height) of the glass panel 4*g* increases so that a critical situation may occur in enduring the transverse bending deformation of the glass panel 4*g* only with the rigidity of the glass panel 4*g* under a strong wind pressure condition, and the transverse bending deformation with reference to the vertical line of the glass panel 4*g* may exceed a yield point of the glass panel 4*g* due to the strong wind (wind pressure). In such a case, there is a strong likelihood that the glass panel may be destroyed.

In order to solve this problem, as illustrated in FIG. 8, an improved structure may be preferably adopted which is provided with an additional means capable of controlling the transverse bending deformation of a glass panel 41 by configuring a sliding window 40 including the glass panel 41 supported by a roller 43 and rigidly joining a separate vertical stiffener 42 to a side surface of the glass panel. The vertical stiffener 42 is provided to exhibit high rigidity as compared to a case where only the glass panel 4*g* is provided as described above. Most preferably, when a stiffener 42 made of a material which may exhibit high bending rigidity with the same thickness as that of the glass panel 41 is rigidly joined to the side surface of the glass panel 41, it may be of help to simplify the lower support structure. Due to a limit in rigidity of raw materials of conventionally used construction materials, however, the vertical stiffener 42 will have a structure, of which the thickness b1 is thicker than the thickness b1 of the glass panel 41 as illustrated in FIG. 8. Meanwhile, the lower end of the vertical stiffener 42 is formed as a stiffener's narrow end 42*a*, of which the thickness b4 is reduced such that it may be inserted into the width b2 of the opening of the lower pocket guide 13 provided in the lower door guide frame 10 including the roller guide rail 11 that supports the roller 43 of the sliding window 40. Further, the upper end of the vertical stiffener 42 should also be formed as a stiffener's narrow end of which the thickness b4 is reduced such that it may be inserted into the width of the opening of the upper pocket guide 14 provided to be downwardly opened on the upper door guide frame 10, which constitutes the window frame of the sliding window 40. In such a case, as illustrated in the cross-sectional view of FIG. 9, the smooth movement of the sliding window 40 may be ensured when predetermined separation distances (reference numerals e and e' in FIG. 9) are secured between the heights of the thickness-reduced stiffener's narrow-ends 42*a* and the heights of the lower pocket guide 13 and the upper pocket guide 14 which are provided in the lower and upper portions of the door guide frame 10, respectively. However, when the separation distances e and e' increase, the resistance against the wind pressure is weakened.

In addition, when the thickness b3 of the vertical stiffeners 42 is larger than the width b2 of the openings of the lower pocket guide 13 and the upper pocket guide 14, the thickness b4 of the stiffener's narrow-ends 42*a* should be reduced to be capable of being inserted into the width b2 of the openings of the lower and upper lower pocket guides 13 and 14.

Of course, even in such a case, another requirement that the minimum value Min (e', g') (denoted by reference numeral h in FIG. 10) between the separation distance e' between the lower end of the upper stiffener's narrow end 42 of the sliding window 40 and the outer lower end of the upper pocket guide 14 provided in the upper portion of the door guide frame 10 and the spacing distance g' between the inner upper end of the upper pocket guide 14 and the upper end of the sliding window 40 should be larger than the depth of the glass panel 41 (denoted by reference numeral f in FIG. 12) inserted into the lower pocket guide 13 (h=Min(e', g')>f) should be satisfied so that, so that when the sliding window 40 is lifted upward as illustrated in FIG. 10, the lower end of the stiffener narrow-end 42*a* may be released from the opening of the lower pocket guide 13 as illustrated in FIG. 11 so as to enable installation/removal of the sliding window 40 in the state where the vertical stiffeners 42 are integrated with the glass panel 41. However, here, in order to secure a sufficient upward displacement which may be obtained when the sliding window 40 is fully lifted, it may be preferable to provide a structure in which the separation distance e' between the lower end of the upper stiffener's narrow end 42*a* of the sliding window 40 and the outer lower end of the upper pocket guide 14 provided in the upper portion of the door guide frame 10 is set to be larger than the separation distance g' between the inner upper end of the upper pocket guide 14 and the upper end of the sliding window 40.

Whereas, as illustrated in FIG. 12, when the minimum value Min (e', g') (denoted by reference numeral h in FIG. 10) between the separation distance e' between the lower end of the upper stiffener's narrow end 42 of the sliding window 40 and the outer lower end of the upper pocket guide 14 provided in the upper portion of the door guide frame 10 and the spacing distance g' between the inner upper end of the upper pocket guide 14 and the upper end of the sliding window 40 is smaller than the depth of the glass panel 41 (denoted by reference numeral f in FIG. 12) inserted into the lower pocket guide 13 (h=Min(e', g')<f), it is impossible to secure an upward displacement which may be obtained when the sliding window 40 is fully lifted so that the lower end of the stiffener narrow-end 42*a* cannot be released from the opening of the lower pocket guide 13 due to interference of an upper end protrusion of the lower pocket guide 13. Thus, the sliding window 40 cannot be installed/removed merely by lifting and rotating the sliding window 40 so that the lower end is released from the lower pocket guide 13. Up to now, the removal/installation by lifting the sliding window 40 has been described with reference to FIGS. 9 to 11. On the contrary, a requirement of enabling the installation/removal of the sliding window 40 and a requirement of disabling the installation/removal of the sliding window 40 exist separately in the method of rotating the upper end of the sliding window 40 in the state where the roller 43 below the sliding window 40 is removed from sliding window 40 and lowering the sliding window 40 so as to cause the upper end of the sliding window 40 to be released from the upper pocket guide 14. However, since this is symmetrically similar to the above-described case, redundant descriptions will be omitted. However, a person ordinarily skilled in the art may easily understand and conceive the contents omitted due to the redundancy.

As described above, a case corresponding to the requirement of disabling the removal/installation in relation to the door guide frame 10 of the sliding window 40 formed by rigidly joining the vertical stiffeners 42 to a side surface of the glass panel 41 may occur. In such a case, as illustrated in FIG. 12, an inconvenience may occur in that the vertical stiffeners 42 should be joined to the glass panel 41 through an on-site installation method after the glass panel 41 is installed by inserting the glass panel 41 into the upper pocket guide 14 and the lower pocket guide 13. Once the installation is completed, the sliding window 40 cannot be separated from the door guide frame 10 unless the vertical stiffeners 42 are separated from the glass panel 41 again or the glass panel 41 is damaged.

In order to enable the factory production of the sliding window 40 provided with the vertical stiffeners 42 without causing inconvenience in the on-side installation of the vertical stiffeners 42, and after the installation, to avoid the problem that makes the separation of the sliding window 40 including the vertical stiffeners 42 impossible, a sufficient separation distance e should be secured between the upper end of the stiffener's narrow end 42*a* and the upper end of the lower pocket guide 13 provided in the lower portion of the door guide frame 10. However, in such a case, structural instability in relation to the wind pressure is caused due to the excessive separation distance e and there is a considerable disadvantage in hermeticity.

In addition, the installation structure of the ordinary sliding window in the prior art has a conventional installation structure in which the lower door guide frame that constitutes the window frame supporting the sliding window is installed on a floor surface of a building after the floor surface is constructed. However, such an installation structure also has a problem in that the door guide frame and the roller guide rail included therein protrude upward from the floor surface, thereby detracting from the beauty and serving as an obstacle in relation to a pedestrian or a moving object crossing them. As a result, installation of the sliding door itself may be abandoned in some cases.

In addition, when construction is performed such that a portion connecting an indoor area inside of a building and an outdoor terrace is entirely opened and a window is installed therein, a folding door or the like is frequently installed since it is difficult to implement a large sliding window by using a sliding door roller and a support structure thereof according to the prior art is used. However, the folding door has a problem in that since the folding door requires a folding space, the availability of the building floor surface deteriorates.

DETAILED DESCRIPTION OF THE INVENTION

Technical Problem

The present invention has been made in order to solve the problems in the prior art and a technical object of the present invention is to provide a structure adopted for supporting a smooth movement of a sliding window, in which a glass panel forming the sliding window which constitutes a sliding window system is directly placed on and supported by a roller member without a separate quadrilateral door sash that supports the glass panel forming the sliding window so as to minimize a phenomenon of reducing the open view through the sliding window that constitutes the sliding window system, and upper and lower pocket guides are respectively formed in upper and lower door guide frames used as window frame members that guide a sliding movement of the sliding window so that the upper and lower pocket guides guide the upper end and lower end of the sliding window in both inner and outer surfaces (front and rear surfaces/inner and outer surfaces) of the sliding window, characterized in that factory production of the sliding window provided with vertical stiffeners may be technically allowed by rigidly joining the vertical stiffeners having an enlarged cross-section (having a thickness larger than that of the glass panel) to both side surfaces of the glass panel that constitutes the sliding window including the glass panel supported by the roller so as to reinforce the transverse bending rigidity of the glass panel, and configuring the sliding window provided with the vertical stiffeners to be integrally installed within the door guide frame, and the sliding window provided with the vertical stiffeners may be separated even after the installation of the sliding window.

In addition, the present invention is to provide a technical means capable of improving water-tightness, air-tightness, and heat insulation as well, in achieving the above-described technical object.

Further, another technical object of the present invention is to provide a sliding window installation structure in which a door guide frame and a roller guide frame do not protrude above a floor surface of a building when a structure in which a lower portion of a window frame is positioned on a floor surface of a building so as to secure a wider open view is adopted as the sliding window installation structure.

Technical Solution

In order to solve the above-described problems, the present invention provides a sliding window installation structure including a door guide frame of a separable and removable segment structure, in which a glass panel forming the sliding window (e.g., a pair glass) constituting a sliding window system is removably seated on and supported by rollers without a separate quadrilateral door sash that supports the glass panel forming the sliding window so as to minimize a phenomenon of reducing an open view through the sliding window, and upper and lower pocket guides are respectively formed in upper and lower door guide frames used as a window frame member that guides a sliding movement of the sliding window so as to guide the upper end and lower end of the sliding window in both inner and outer surfaces (front and rear surfaces/inner and outer surfaces) of the sliding window, thereby supporting a smooth movement of the sliding window.

Vertical stiffeners with an enlarged cross-section (cross-section having a thickness thicker than the glass panel) may be attached to both side surfaces of the glass panel that constitutes the sliding window including the glass panel supported by the rollers so as to reinforce transverse bending rigidity of the glass panel.

In order to allow the sliding window provided with the vertical stiffeners to be integrally installed within a door guide frame, and to allow the sliding window to be separated from the door guide frame in a state where the sliding window is provided with the vertical stiffeners, a pocket guide configured to guide and support a stiffener's narrow end formed at an end of each vertical stiffener to have a reduced cross-sectional thickness on both inner and outer surfaces of the sliding window is installed to be separable from a door guide frame body in a direction parallel to the travel direction of a roller guide rail installed on a base surface of the door guide frame body including an opening having a size larger than the cross-sectional thickness of the vertical stiffener. The pocket guide is formed by pocket guide segments removable from the door guide frame body, and the pocket guide segments are successively installed to be separable from each other on both the inner and outer surfaces of the sliding window along the travel direction of the roller guide rail.

The pocket guide segments provided as the pocket guide may be provided in at least one of an upper structure and a lower structure of the door guide frame, when the pocket guide segments are both the upper and lower structures of the door guide frame, so that the sliding window may be variously installed and removed.

Here, the pocket guide segments provided as the pocket guides inside and outside of the sliding window may be divisionally formed as two or more segments over the entire length of the roller guide rail, and one or more segments may be formed to have a length removable from the door guide frame body in a state where the sliding window is installed to be seated on the rollers on the roller guide rail. In addition, the length of the pocket guide segments may be determined to be smaller than an inner gap between the vertical stiffeners attached to the both sides of the sliding window.

In order to improve dust resistance (dust inflow prevention capability), water-tightness, and air-tightness of the sliding window system having the above-described structure, blocking members such as mohairs or elastic gaskets may be installed in a horizontal longitudinal direction on opposite surfaces of the pocket guide segments provided as the pocket guides and the sliding window. More preferably, each of the elastic gaskets provided as the blocking members may include a fixed end fixed to the sliding window and an elastically deformable end which is in contact with an opened surface of the pocket guide segments provided as the pocket guides to be deformed outwardly.

In order to improve window openness and heat insulation, a vertical stiffener insertion channel may be provided inside of the vertical guide frame forming the door guide frame so that the vertical stiffener constituting the sliding window is inserted into and concealed when the sliding window is closed, and a vertical elastic gasket may be provided in an end of the vertical guide frame provided with the vertical stiffener insertion channel to hermetically block a gap between the vertical guide frame and the vertical stiffener.

Further, the lower structure of the door guide frame, in which the pocket guide segments are removably installed in the door guide frame body, may be embedded in a floor surface of a building.

Advantageous Effects

According to the present invention, since the glass panel forming the sliding window constituting the sliding window system is directly mounted on the roller member to be supported without a separate quadrilateral door sash that supports the glass panel forming the sliding window, a phenomenon of reducing an open view through the sliding window can be minimized. Since the vertical stiffeners having an enlarged cross-section (cross-section having a thickness thicker than the glass panel) are rigidly joined to the opposite side surfaces of the glass panel supported by the roller, the transverse bending rigidity of the glass panel can be reinforced to exhibit high wind pressure resistance. Further, the sliding window is configured to be installed inside of the door guide frame to be integrally installed in a state in which the sliding window is provided with the vertical stiffeners, so that the sliding window can be directly manufactured in a factory. Moreover, the sliding window having an enlarged cross-section by being provided with the vertical stiffeners can be removed from the door guide frame even after installation without any interference.

In addition, the sliding window system according to the present invention may also improve water-tightness, air-tightness, and heat insulation.

Further, according to the present invention, the door guide frame serving as the lower structure of the window frame is configured to be positioned under a floor surface of a building so as to secure a wider open view in the sliding window installation structure. Thus, it is possible to provide a sliding window installation structure in which the door guide frame and the roller guide rail do not protrude above the floor surface of the building.

MODE FOR CARRYING OUT THE INVENTION

Hereinafter, embodiments of the present invention will be described with reference to the accompanying drawings such that a person ordinarily skilled in the art to which the present invention belongs may easily embody the present invention. However, the present invention may be implemented in various forms and is not limited to the embodiments described herein.

Figure 14:
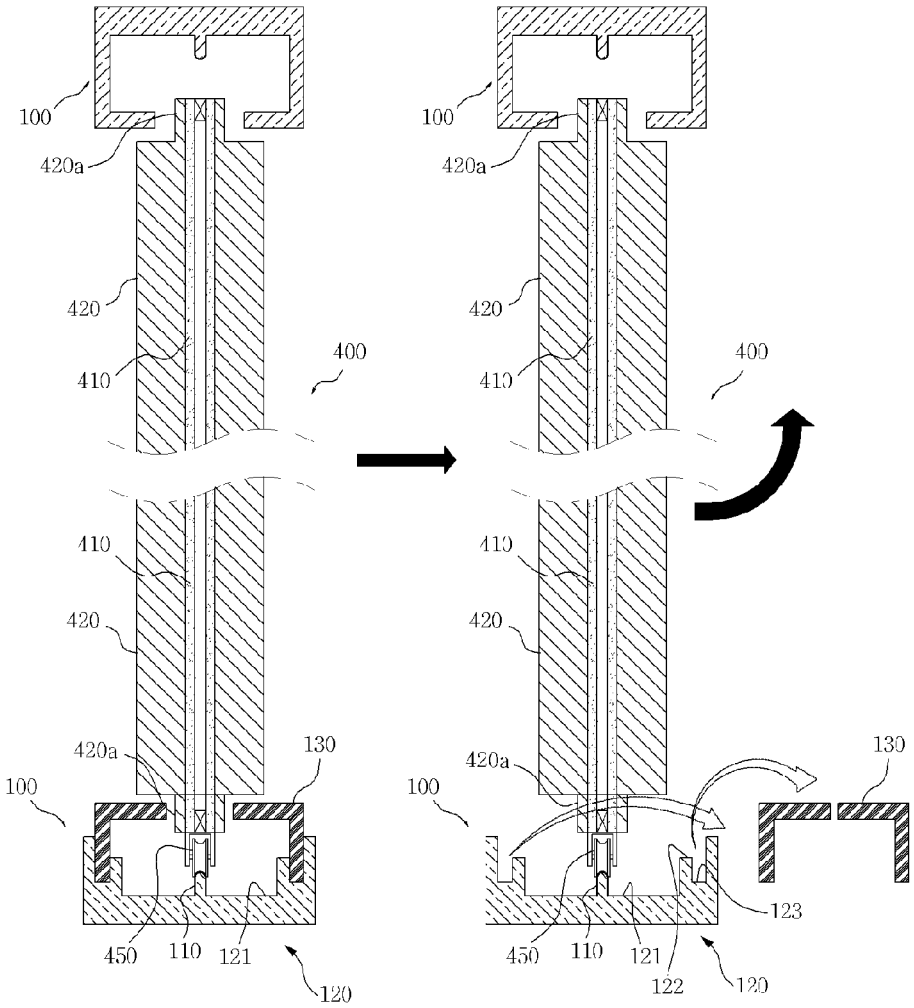
FIG. 14 is a cross-sectional view illustrating a sliding window installation structure according to the present invention.
Figure 15:
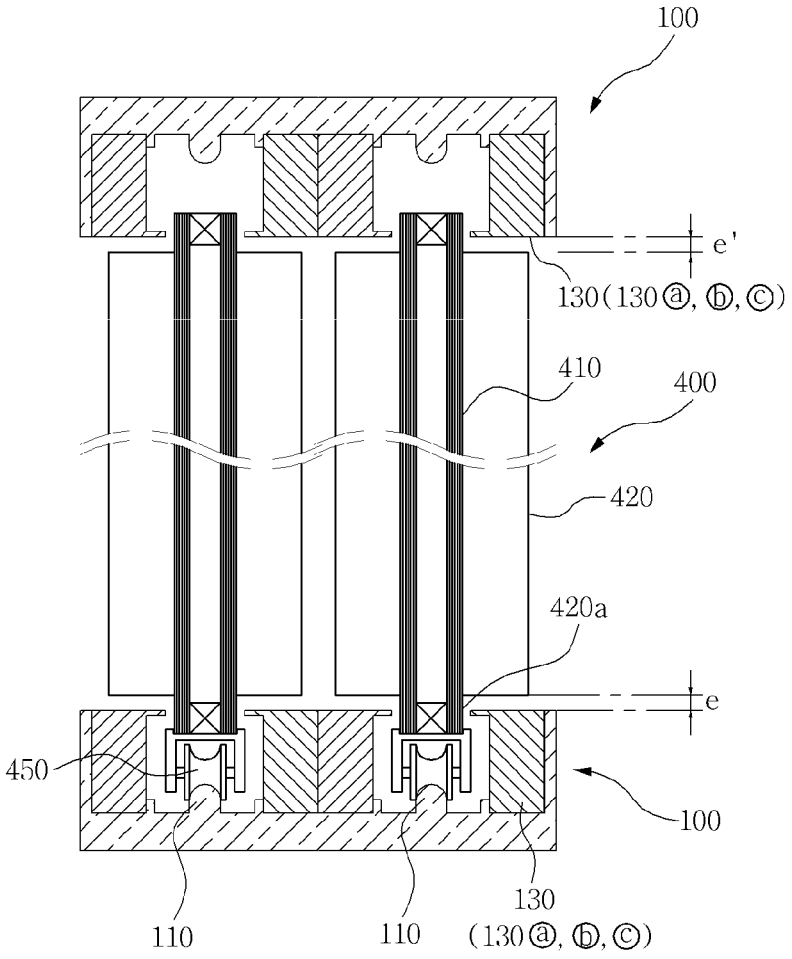
FIGS. 15 to 17 are cross-sectional views illustrating a sliding window installation structure in according to a first embodiment of the present invention which conventional axial type rollers are used, and an operating state thereof.
Figure 16:
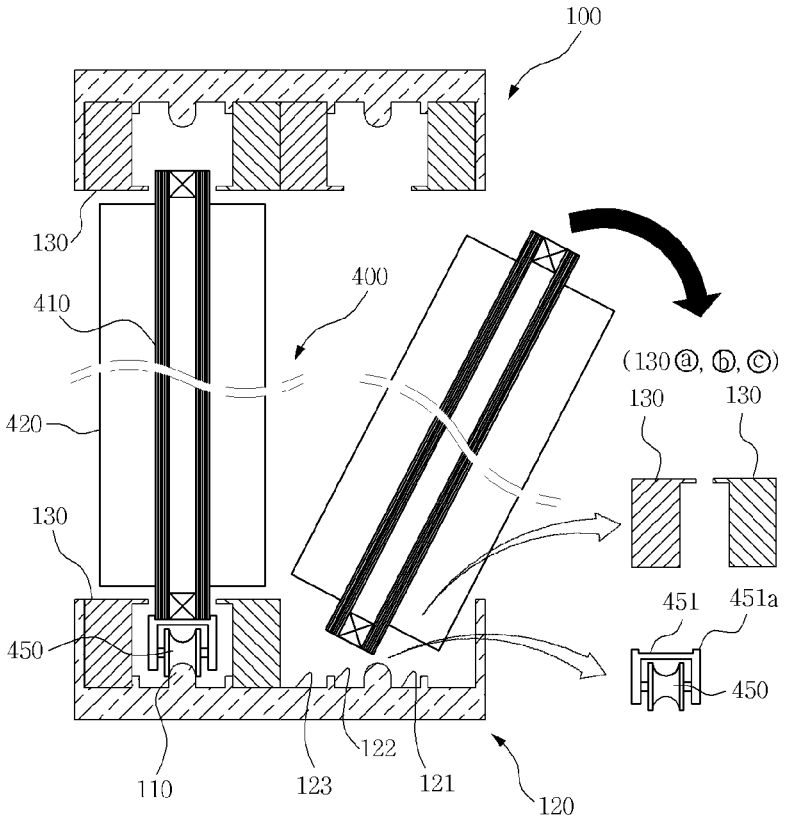
Figure 17:
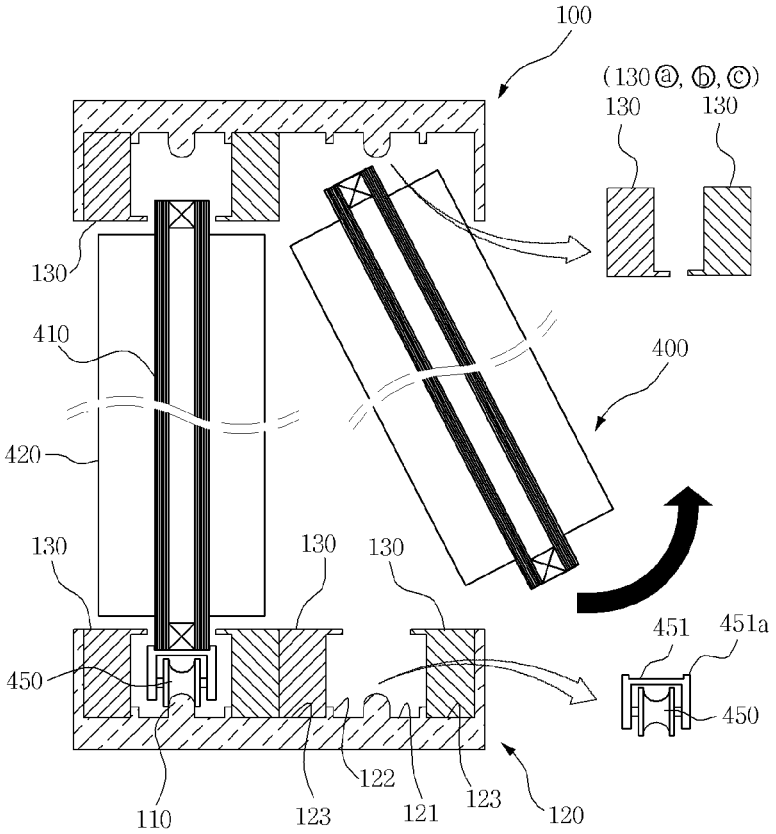

As described above, the present invention is intended to solve a problem of weakening wind pressure resistance due to lack of rigidity of a sliding window improved to enhance openness of a window as described above as well as a problem caused when installing/removing the sliding window simultaneously. FIG. 14 is a cross-sectional view illustrating a sliding window installation structure according to the present invention FIGS. 15 to 17 are cross-sectional views illustrating a sliding window installation structure according to a first embodiment of the present invention in which conventional axial type rollers are used, and an operating state thereof.

An embodiment of the present invention exemplified in the drawings provides a sliding window installation structure for supporting a smooth movement of a sliding window 400, in which a glass panel (e.g., a pair glass) 410 forming the sliding window 410 which constitutes a sliding window system is directly placed on and supported by rollers 450 without a separate quadrilateral door sash that supports the glass panel 410 forming the sliding window 400 so as to minimize a phenomenon of reducing an open view through the sliding window 400, and upper and lower pocket guides 130 are respectively formed in upper and lower door guide frames 100 used as window frame members that guide a sliding movement of the sliding window so that the upper and lower pocket guides 130 guide the upper end and lower end of the sliding window in both inner and outer surfaces (front and rear surfaces/inner and outer surfaces) of the sliding window 400.

Vertical stiffeners 420, each of which has an enlarged cross-section (having a thickness larger than that of the glass panel), are attached to both side surfaces of the glass panel 410 that constitutes the sliding window 400 including the glass panel 410 supported by the rollers 450 so as to reinforce the transverse bending rigidity of the glass panel 410.

In order to allow the sliding window 400 provided with the vertical stiffeners 420 to be integrally installed within a door guide frame 100, and to allow the sliding window 400 to be separated from the door guide frame 100 in a state where the sliding window 400 is provided with the vertical stiffeners 420, the sliding window installation structure includes: a door guide frame with a separable and removable segment structure, in which a pocket guide 130 configured to guide and support a stiffener's narrow end 420*a* formed at an end of each vertical stiffener 420 to have a reduced cross-sectional thickness on both inner and outer surfaces (front and rear surfaces/inner and outer surfaces) of the sliding window 400 is installed to be separable from a door guide frame body 120 in a direction parallel to the travel direction of a roller guide rail 110 installed on a base surface 121 of the door guide frame body 120 including an opening having a size larger than the cross-sectional thickness of the vertical stiffener 420, in which the pocket guide 130 is formed by pocket guide segments 130 (130*a*, 130*b*, or 130*c*) (see FIGS. 22 to 27) removable from the door guide frame body 120, and the pocket guide segments 130 (130*a*, 130*b*, or 130*c*) are successively installed to be separable from each other on both inner and outer surfaces of the sliding window 400 along the travel direction of the roller guide rail 110.

Here, in order to removably install the pocket guide 130 on the base surface 121 of the door guide frame body 120, as illustrated in FIG. 14, partition walls 122 are formed outside of the base surface 121 to protrude along the travel direction of the roller guide rail 110, in which the roller guide rail 110 is provided at a central portion of the base surface 121, so that accommodation portions 123 may be formed between outer walls of the door guide frame body 120 and the partition walls 122 so as to install the pocket guide 130 by inserting the pocket guide 130 into the accommodation portions 123.

In addition, the pocket guide segments 130 (130*a*, 130*b*, or 130*c*) provided as the pocket guide 130 may be provided in an upper structure and/or a lower structure of the door guide frame 100 (in the state illustrated in FIG. 14, the pocket guide segments are provided only in the lower structure). When the pocket segments 130 (130*a*, 130*b*, or 130*c*) are provided in both the upper structure and the lower structure of the door guide frame 100 as illustrated in FIGS. 15 to 17, the sliding window 400 may be installed/removed in various directions.

Upon comparing the first embodiment illustrated in FIGS. 15 to 17 with the basic structure illustrated in FIG. 14, the shapes of the pocket guide segments (130: 130*a*, 130*b*, or 130*c*) provided as the pocket guides 130 at both structures and the shapes of the accommodation portions 123 in which the pocket guides 130 may be installed by being inserted are differently illustrated in the drawings. However, although the functional principles of both structures are substantially equal to each other, the first embodiment further improves the structural stability.

According to the sliding window installation structure including the door guide frame with the separable and removable segment structure as described above, when the pocket guide segments 130 (130*a*, 130*b*, or 130*c*) provided as the pocket guide 130 in one of the upper structure and the lower structure of the door guide frame 100 as illustrated in FIGS. 16 and 17 are removed from the door guide frame 100, the sliding window 400 may be easily separated from the door guide frame 100 even if the sliding window 400 is provided with the vertical stiffeners 420. On the contrary, the sliding window 400 may be easily assembled to and installed in the door guide frame 100 in the state where the vertical stiffeners 420 are integrated through a production process in a factory or the like. In addition, as illustrated in FIG. 15, the separation distance e' between the lower end of the stiffener's narrow end 420*a* in the upper portion of the sliding window 400 and the outer lower end of the upper pocket guide 130 provided in the upper portion of the door guide frame 100, and the separation distance e between the upper end of the stiffener's narrow end 420*a* in the lower portion of the sliding window 40 and the outer upper end of the upper pocket guide 130 provided in the upper portion of the door guide frame 100 can be minimized, and a structure capable of maximizing the wind pressure resistance and the hermeticity can be achieved.

FIGS. 18 to 21 are views illustrating a sliding window installation structure according to a second embodiment of the present invention in which annular roller devices are used for a sliding window, and an operating state thereof. The second embodiment illustrated in FIGS. 18 to 21 uses annular roller devices 500 specially designed to smoothly support and move a heavy sliding window even if the annular roller devices 500 have a small size, instead of the conventional rollers 450 described above.

Figure 18:
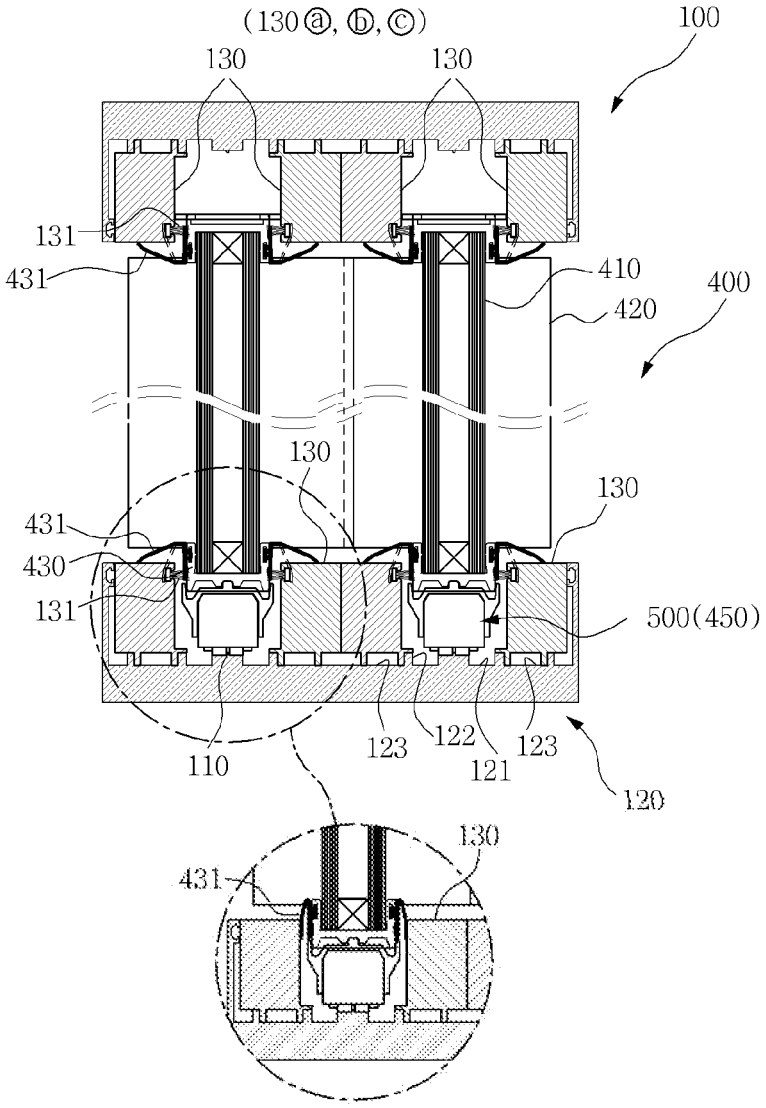
FIGS. 18 to 21 are views illustrating a sliding window installation structure according to a second embodiment of the present invention in which annular roller devices are used for a sliding window, and an operating state thereof.
Figure 19:
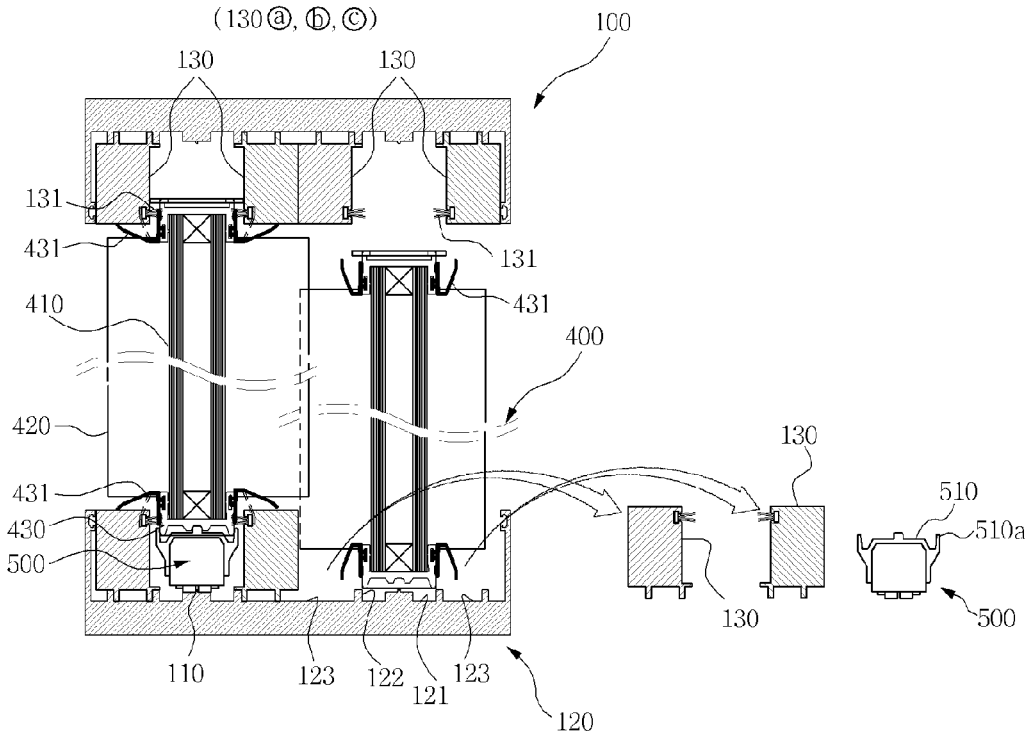

In addition, in order to improve dust resistance, water-tightness, and air-tightness of the sliding window system having the above-described structure, as illustrated in FIGS. 18 and 19, blocking members such as mohairs 131 or elastic gaskets 431 may be installed in a horizontal longitudinal direction on the opposite surfaces of the pocket guide segments 130 (130*a*, 130*b*, or 130*c*) provided as the pocket guides 130 and the sliding window 400.

Here, as illustrated in FIGS. 18 and 19, each of the elastic gaskets 431 provided as the blocking members including a fixed end fixed to the sliding window 400 and an elastically deformable end which is in contact with an opened surface (in the drawings, the top surface in the case of the lower structure/the lower surface in the case of the upper structure) of the pocket guide segments (130: 130*a*, 130*b*, or 130*c*) provided as the pocket guides 130 to be deformed outwardly may be more preferably used from the view point of blocking inflow of rain. Unlike this, when the elastically deformable end of the elastic gasket 431 is in contact with an inner closed surface of the pocket guide segments (130: 130*a*, 130*b*, or 130*c*) provided as the pocket guides 130 to be elastically deformed inwardly as in the case of comparative example A comparatively illustrated in the lower portion of FIG. 18, the elastically deformable end is sandwiched between the sliding window 400 and a pocket guide segment 130 (130*a*, 130*b*, or 130*c*) so that the smooth sliding movement of the sliding window 400 may be hindered due to the friction of the elastically deformable end and the inflow of rain may not be efficiently blocked.

Meanwhile, as illustrated in FIGS. 18 and 19, it is preferable that the elastic gaskets 431 are installed on glass support stages 430 coupled to the lower ends of the glass panels 410 which form a pair glass.

Hereinbelow, a configuration and action of annular roller devices 500 used in the second embodiment will be described with reference to FIGS. 20 and 21.

Figure 20:
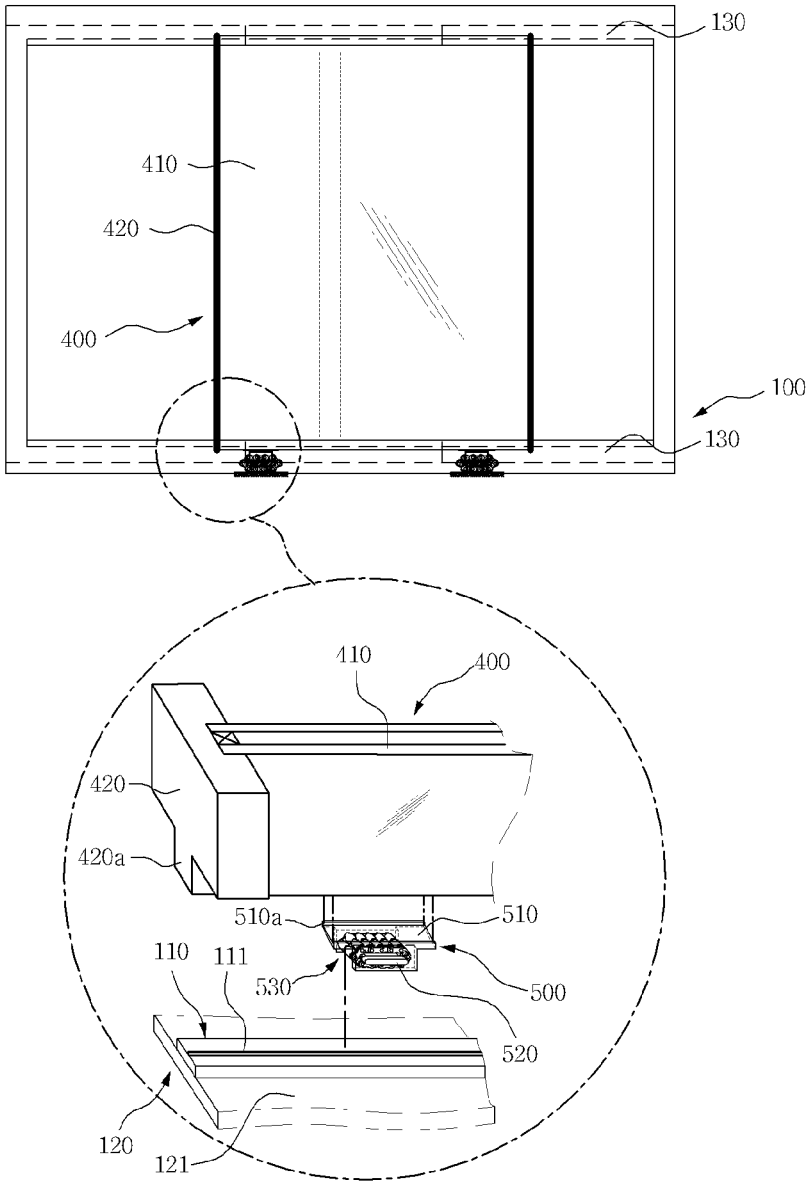
Figure 21:
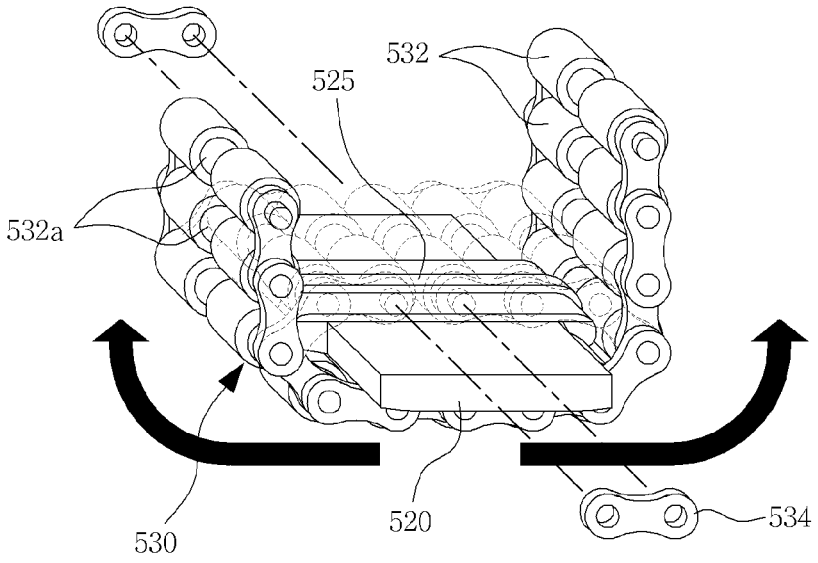

According to the second embodiment of the present invention, an annular roller device 500 is used as the roller member that supports the sliding window 400 below the sliding window 400 and allows the sliding window 400 to be slid along the roller guide rail 110 as illustrated in FIGS. 20 and 21. The annular roller device 500 includes: a glass seat 510 formed by a support bracket on a top central portion to be capable of accommodating a lower end of the glass panel 410 (in FIGS. 18 and 19, a glass support stage 430) that constitutes the sliding window 400; weight support plates 520 formed integrally by extending partition walls formed downwardly at opposite sides of the glass seat 510 from the glass seat 510 and including a guide rail 525 formed along the rail travel direction around the weight support plates 520; a plurality of rolling members 532, each of which is formed in a cylindrical shape laid in a transverse direction to be orthogonal to the rail travel direction and includes a guide recess 532*a* formed on the outer circumferential surface thereof along the rail travel direction; and a plurality of chain link units 534 configured to interconnect the plurality of rolling members 532 such that the plurality of rolling members 532 are evenly disposed in an annular shape on a surface of the weight support plate 520 to be spaced by a preset interval along a door travel direction. The annular roller device 500 further includes an annular rolling unit 530 wound around the top surface and the bottom surface of the weight support plates of the opposite sides of the glass seat 510 and circular arc surfaces formed in the rail travel direction at the opposite ends to interconnect the top surface and the bottom surface.

Figure 1:
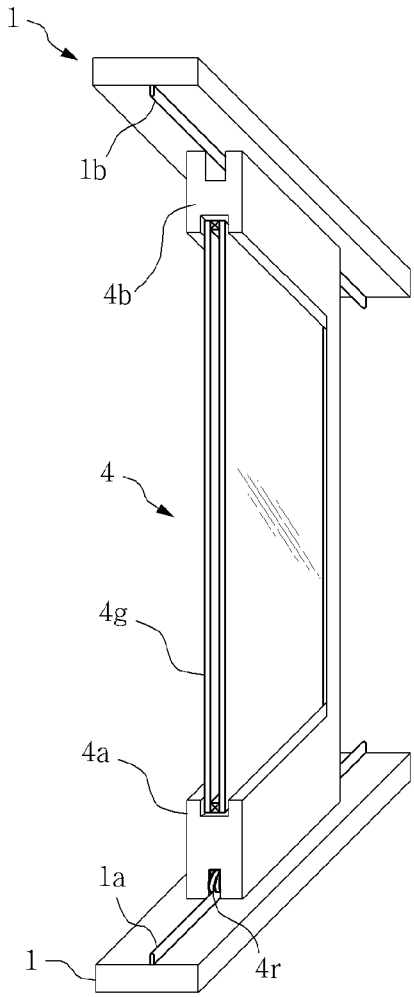
FIGS. 1 and 2 are views illustrating a conventional sliding window system which is provided with a door sash which supports a glass panel on the four sides of the glass panel.
Figure 2:
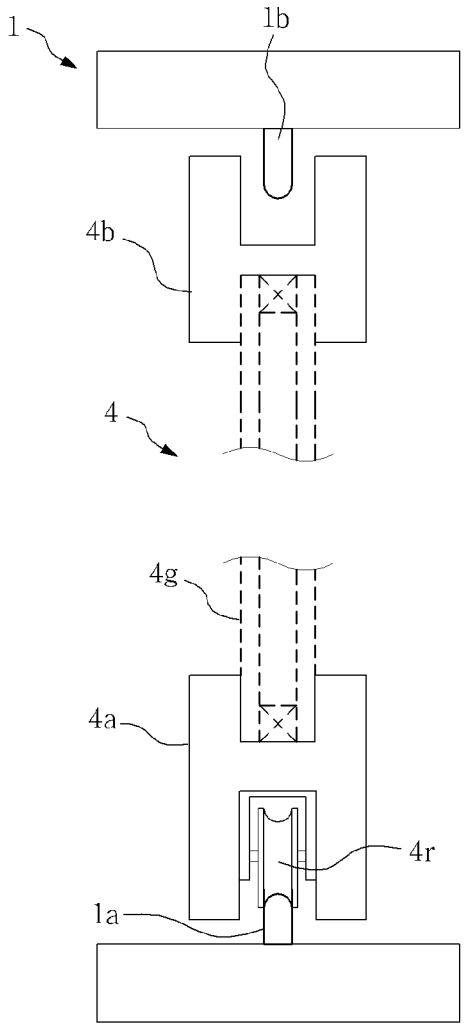
Figure 3:
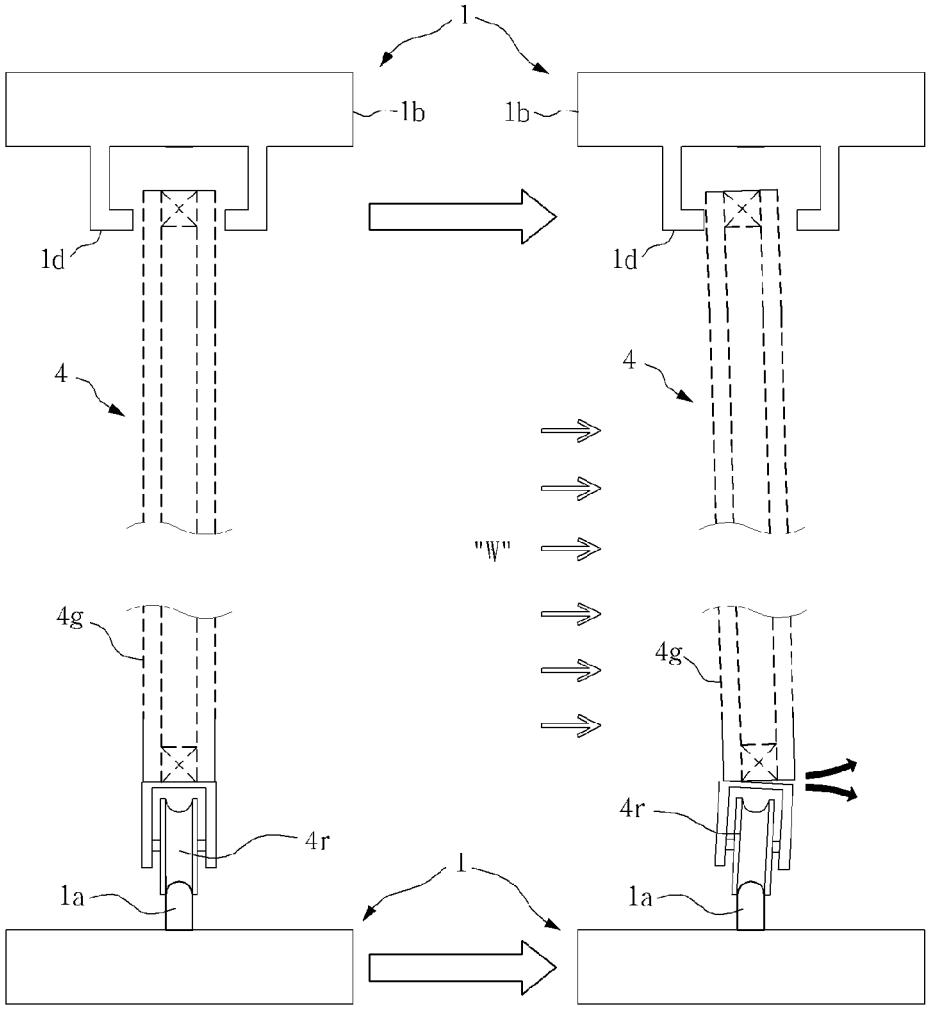
FIGS. 3 to 5 are views illustrating a sliding window installation structure which improves the conventional sliding window system of FIGS. 1 and 2 by directly mounting a glass panel on a roller without a door sash to be used as a sliding window.
Figure 4:
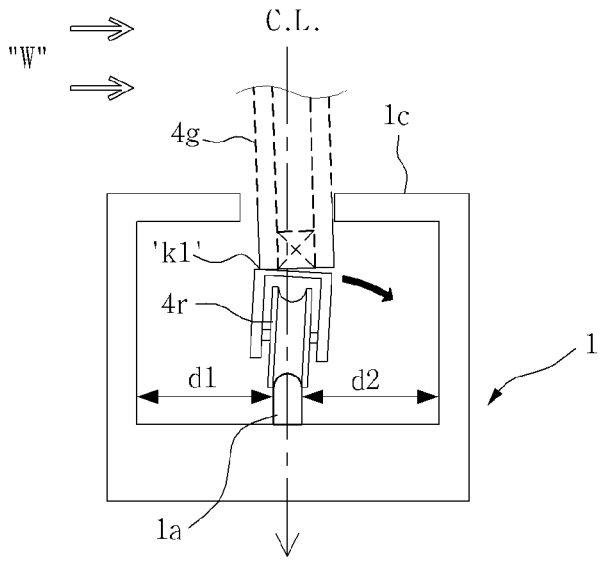
Figure 5:
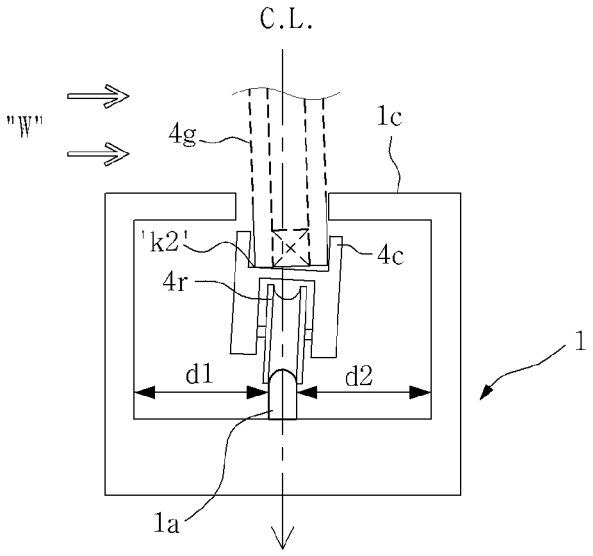
Figure 6:
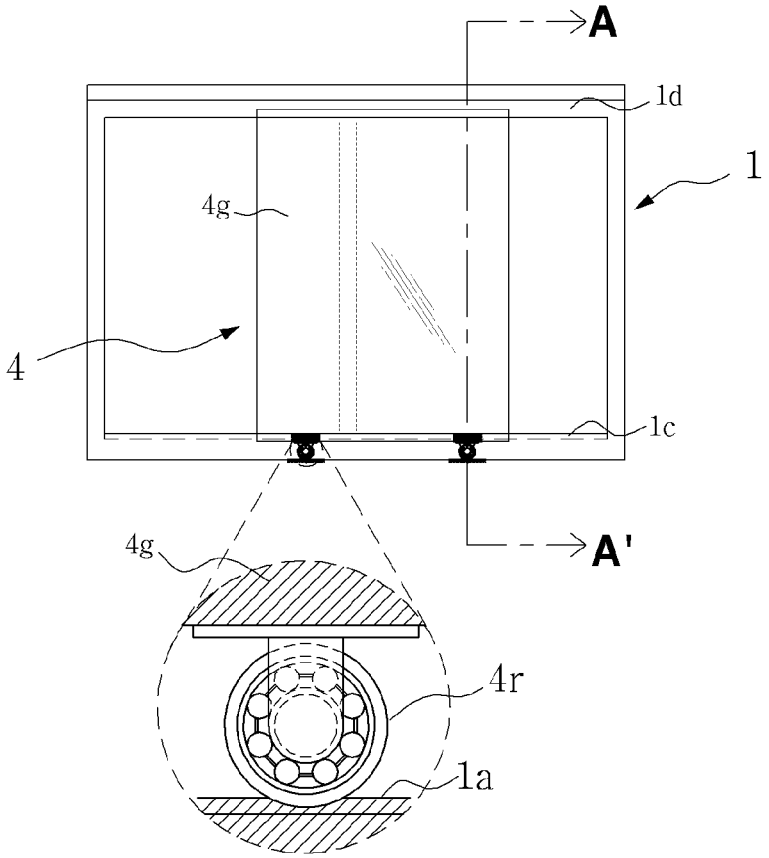
FIGS. 6 and 7 are schematic views for illustrating a problem of reducing wind pressure resistance due to lack of rigidity of the glass panel of the improved sliding window illustrated in FIGS. 3 to 5.
Figure 7:
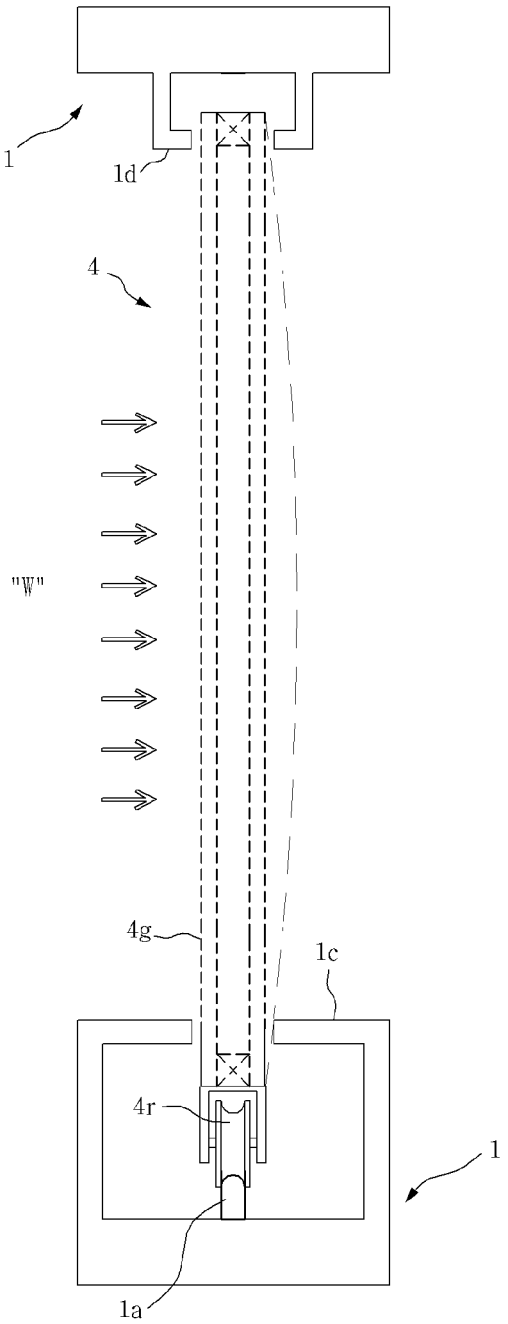
Figure 8:
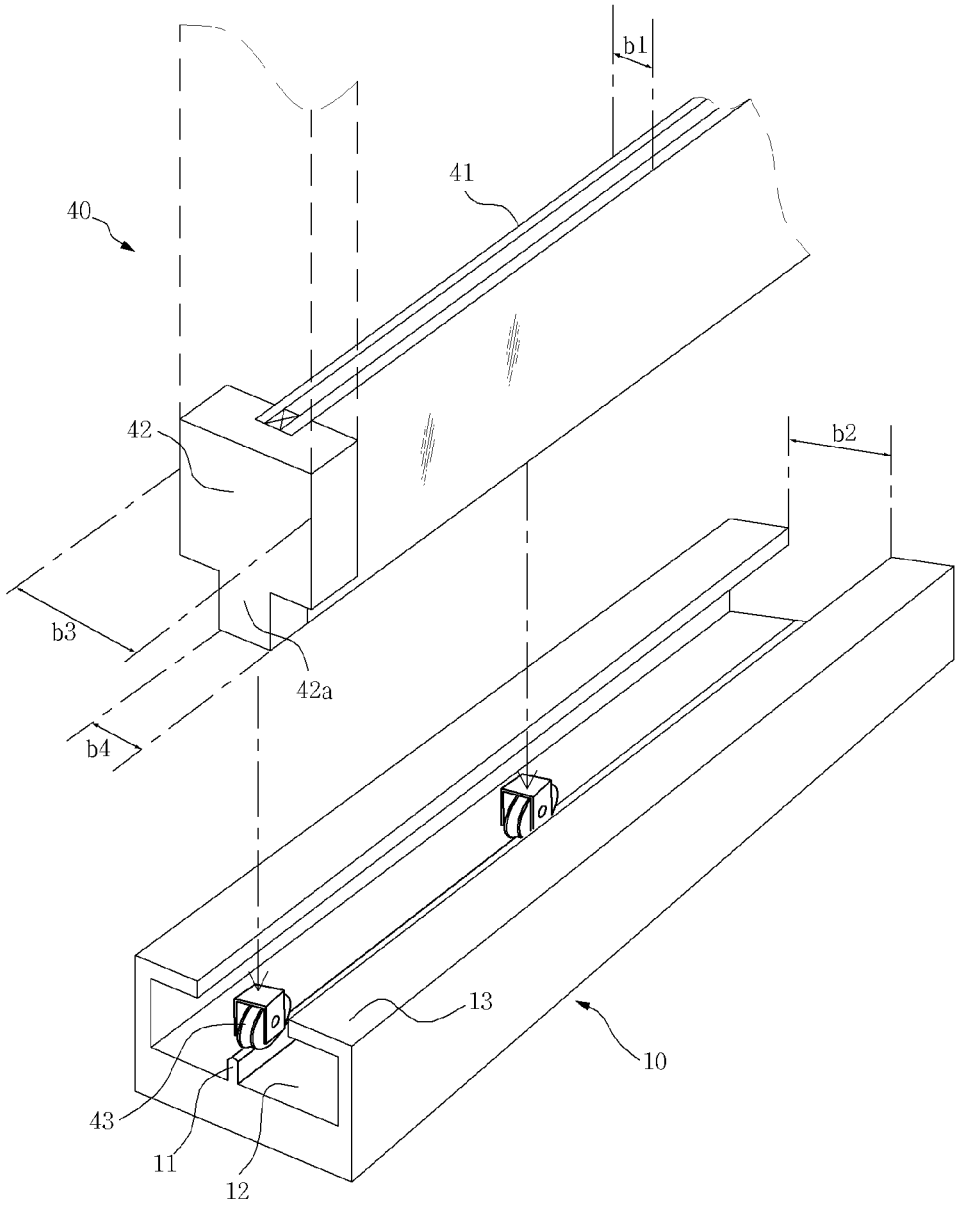
FIG. 8 is a view illustrating a state in which a vertical stiffener is attached to a side surface of the glass panel which constitutes the sliding window in order to solve the problem.
Figure 9:
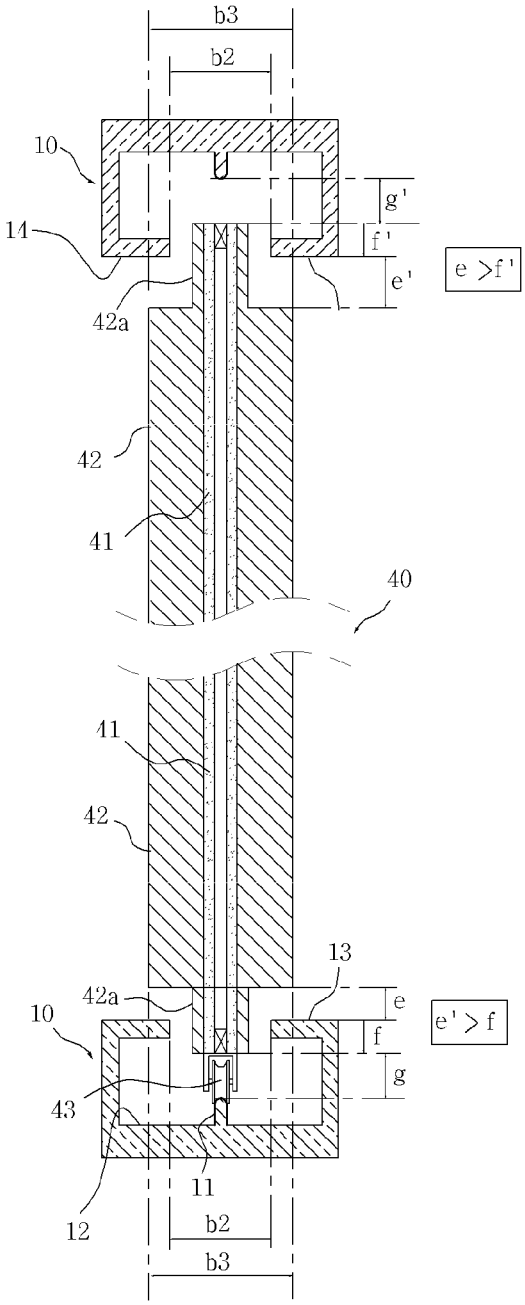
FIGS. 9 to 13 are schematic views for describing problems caused when installing and removing the single window in which the problems are additionally caused in the improved sliding window illustrated in FIG. 8 due to the addition of the vertical stiffeners.
Figure 10:
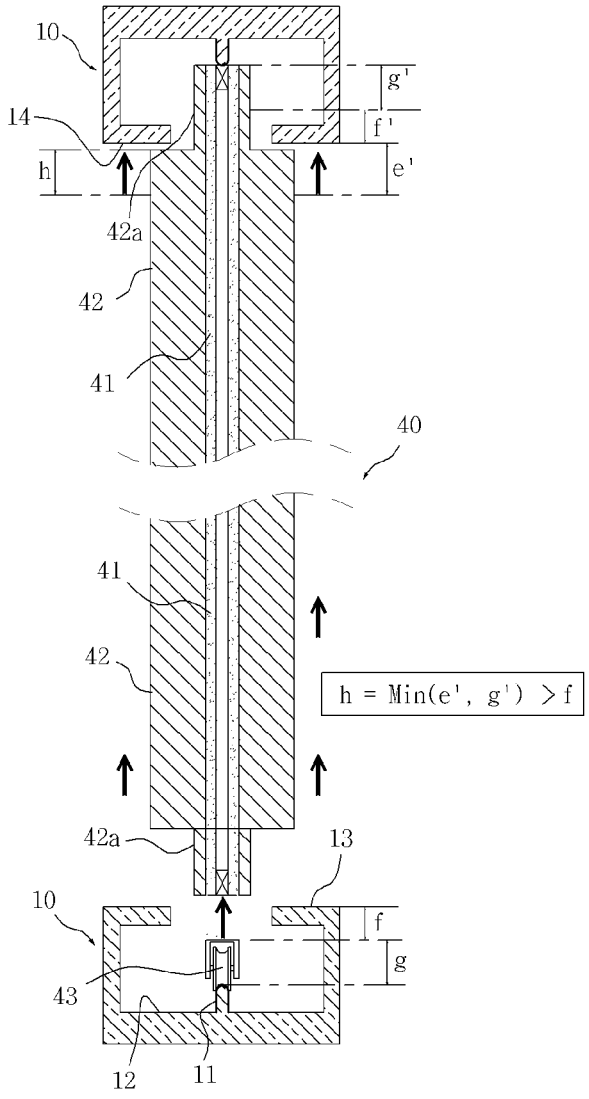
Figure 11:
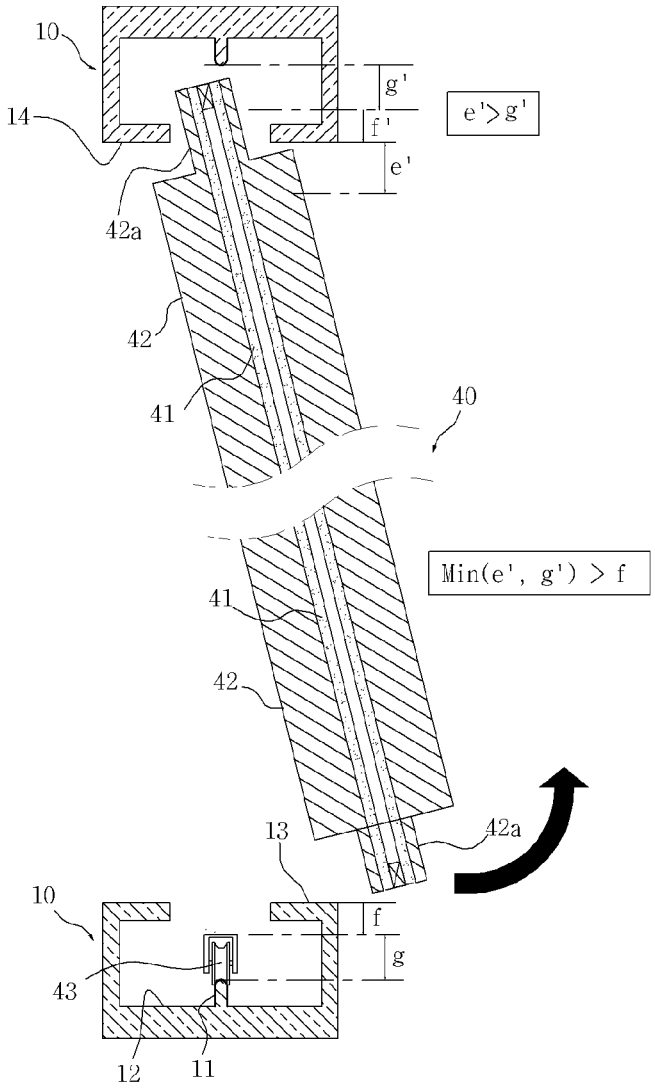
Figure 12:
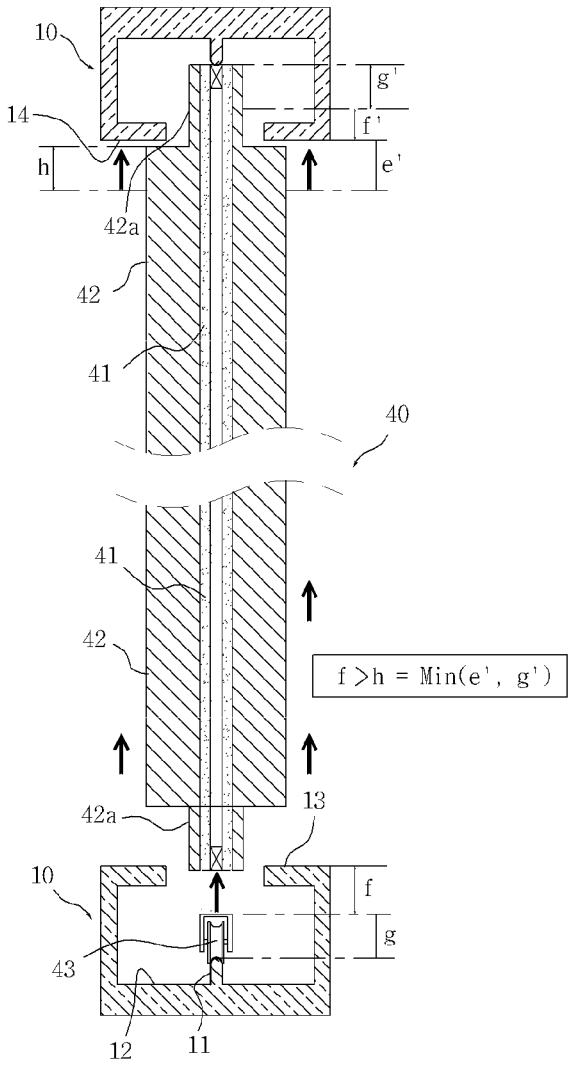
Figure 13:
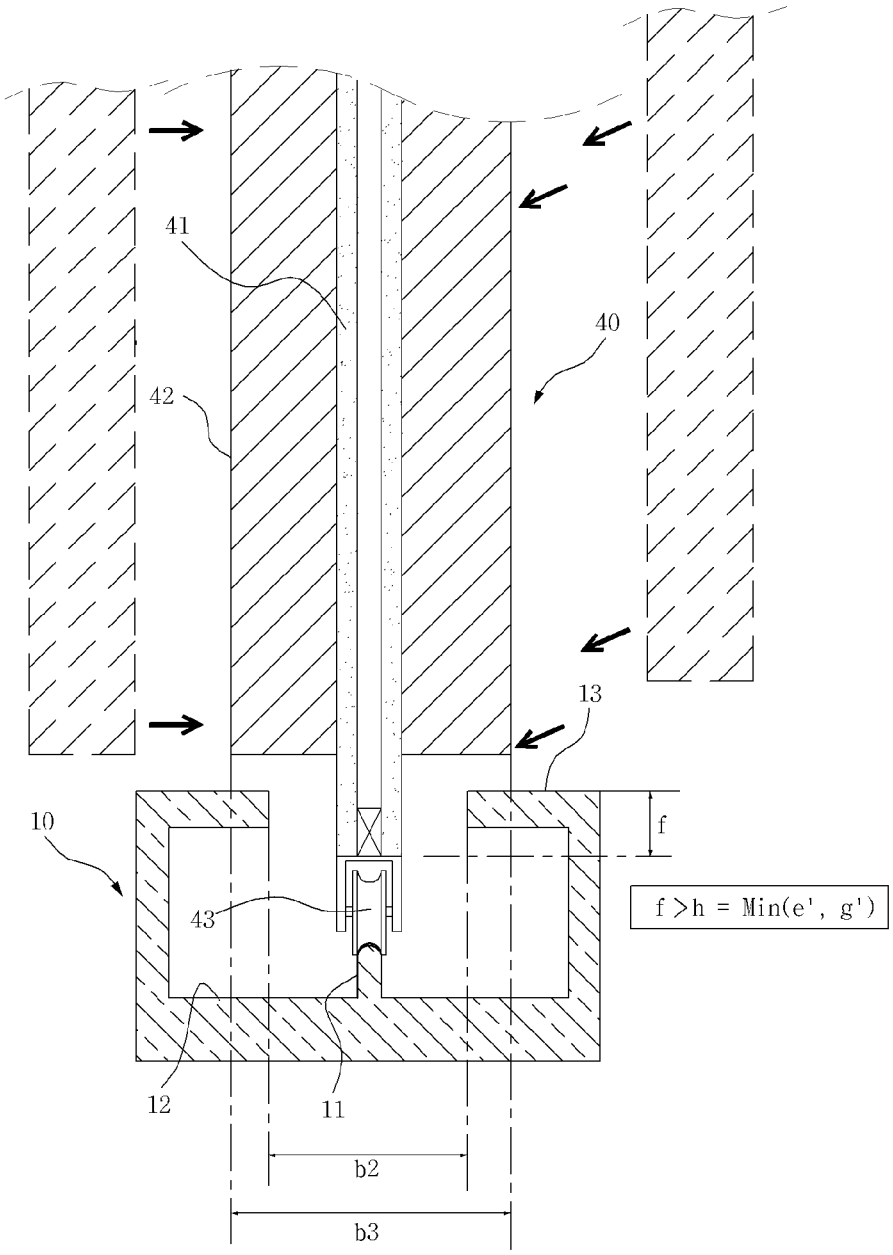

Here, the weight support plates 520 formed at the opposite sides of the glass seat 510 have a flat plate shape and evenly support the weight of the sliding window 400 while serving as a rotation shaft of the annular rolling units 530, and the opposite ends of the weight support plates 520 are formed preferably in a circular arc shape so that the plurality of rolling members 532 may be smoothly rotated on the opposite ends of the weight support plates 520. Since the weight support plates 520 have the flat plate shape unlike the conventional roller device having a cylindrical shape formed with a central bore (see FIG. 5), the entire height may be considerably reduced in transferring and supporting a weight through a wide area. Consequently, the weight support plates 520 may be installed even if the height of an installation height is low.

The annular rolling unit 530 having a configuration as illustrated in FIGS. 20 and 21 are wound around the weight support plates 520 at the opposite sides of the glass seat 510 to rotate around the weight support plates 520 as an axis. specifically, the annular rolling unit 530 includes a plurality of rolling members 532, and a plurality of link units 534 configured to interconnect the plurality of rolling members 532 such that the plurality of rolling members 532 may be spaced apart from each other at a preset interval and evenly distributed on the surfaces of the weight support plates 520, i.e. the top surface, the bottom surface, and the opposite circular arc shapes. Thus, the length of the annular rolling unit 530 may be adjusted to be suitable for the length of the weight support plate by adjusting the number of the rolling members 532 and the length of the link units 534. Further, unlike a conventional roller device having a construction in which the weight of the sliding window 400 is completely concentrated to linear contact surfaces of bearing parts, in the present invention, the plurality of rolling members 532 may support the weight of the sliding window 400 while evenly distributing the weight of the sliding window 400 so that the sliding window 400 which is heavy as compared to the conventional one can be supported. In addition, each of the plurality of rolling members 532 may be made of a self-lubricating material. When the self-lubrication material is used, a lubricant material such as oil may not be separately used so that the costs may be reduced and surroundings may be kept clean.

Meanwhile, a process of assembling the annular rolling unit 530 and the weight support plates 520 will be described with reference to FIG. 21. A corresponding external link members 534 of the annular rolling unit 530 is separated, then the annular rolling unit 530 is wound on the weight support plates 120 such that the guide rails 525 of the weight support plates 520 and the guide recesses 532*a* of the plurality of rolling members 532 correspond to each other, and then the corresponding external link members 534 are fastened. Then, the assembly of the annular rolling unit 530 is completed.

In the case of the annular rolling unit 530 assembled as described above, the guide recesses 532*a* of the plurality of rolling members 532 and the guide rails 525 of the weight support plates 520 are correspondingly engaged with each other, and as illustrated in the lower portion of FIG. 20 in an enlarged scale, the guide recesses 532*a* are also correspondingly engaged with a guide rib 111 of the roller guide rail 110 installed on the base surface 121 of the door guide frame body 120 in the lower structure of the door guide frame 100, so that the annular rolling unit 530 may be smoothly slid while rotating around the weight support plates 520 to maintain the straight travel property of the sliding window 400.

With the annular roller device 500, even if the weight support plates 520 are tilted left and right, tilting of the annular rolling unit 530 to one side (i.e., a phenomenon hindering the smooth straight travel of the sliding window) may be prevented in advance, and slippage of the annular rolling unit 530 to the left or right side of the weight support plates 520 during the annular rolling unit 530 may also be prevented in advance. As such, since the external link members 534 may be prevented from rubbing against the door guide frame 100 in advance, cutting of the annular rolling unit 530 caused by the wear and tear of the external link members 534 may be prevented in advance.

In the case of the sliding window systems according to the embodiments described above, descriptions will be made on the configuration which allows the pocket guide segments 130 (130*a*, 130*b*, or 130*c*) provided as the pocket guides (130) to be easily separated from the body 120 of the door guide frame 100 without interfering with the sliding window 400, and the operating procedure thereof.

First, as illustrated in FIGS. 22 to 30, the pocket guide segments 130 (130*a*, 130*b*, or 130*c*) provided as the pocket guides 130 inside and outside of the sliding window 400 are divisionally formed as two or more segments over the entire length of the roller guide rail 110, and one or more segments may be formed to have a length removable from the door guide frame body 120 in a state where the sliding window 400 are installed to be seated on the rollers 450 on the roller guide rail 110. In addition, the length of the pocket guide segments 130 (130*a*, 130*b*, or 130*c*) may be determined to be smaller than an inner gap between the vertical stiffeners 420 attached to the both sides of the sliding window 400.

Hereinafter, the operation of the present invention will be described with reference to FIGS. 22 to 27, assuming that three pocket guide segments 130*a*, 130*b* and 130*c* are divisionally installed as the pocket guides 130 inside and outside of the sliding window 400 along the entire length of the roller guide rail 110, as an example.

Figure 22:
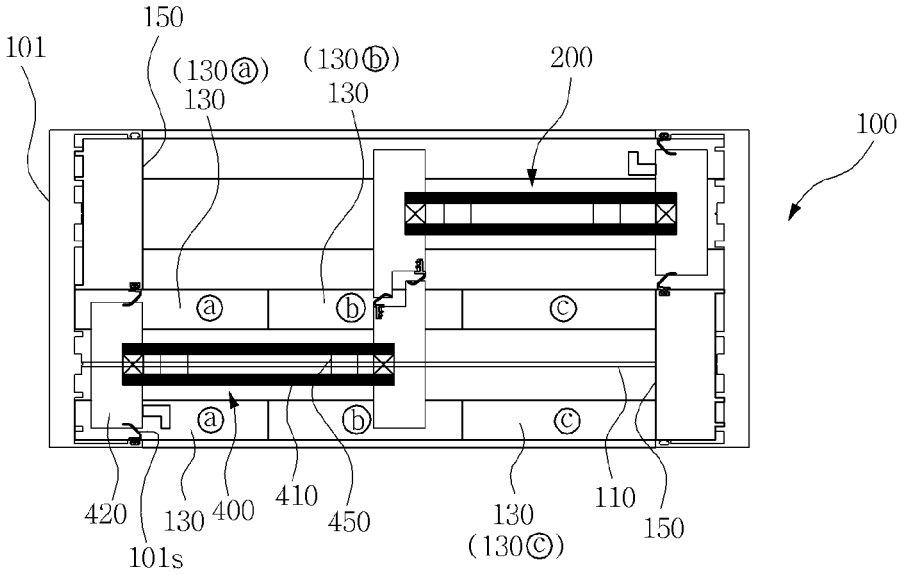
FIGS. 22 to 27 are plan views illustrating in sequence a process of removing pocket guide segments from a door guide frame body and removing a sliding window provided with a vertical stiffener from a window frame in a sliding window installation structure according to the present invention.
Figure 23:
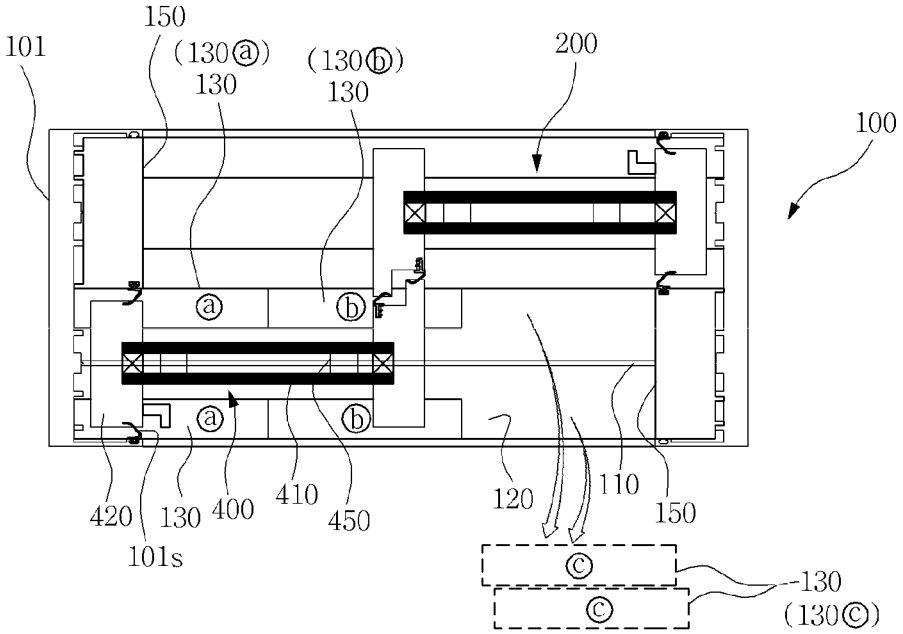
Figure 24:
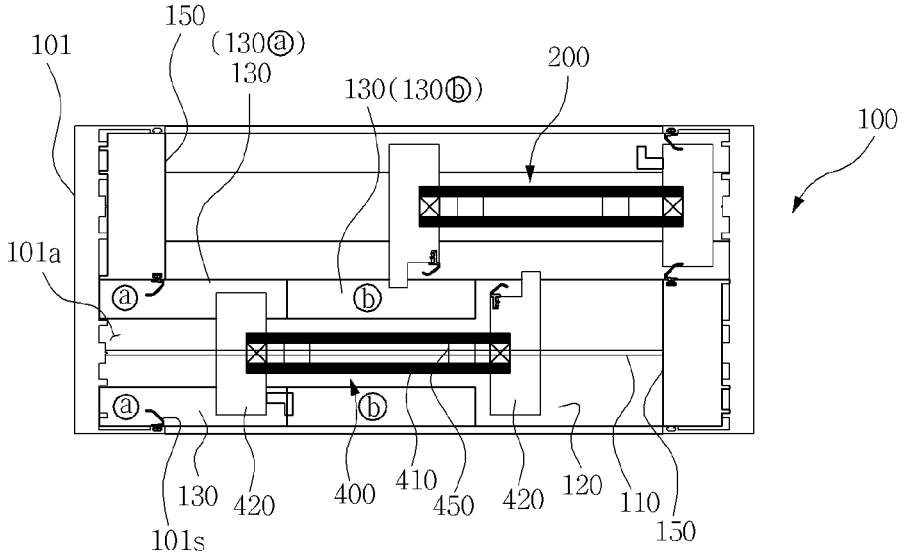
Figure 25:
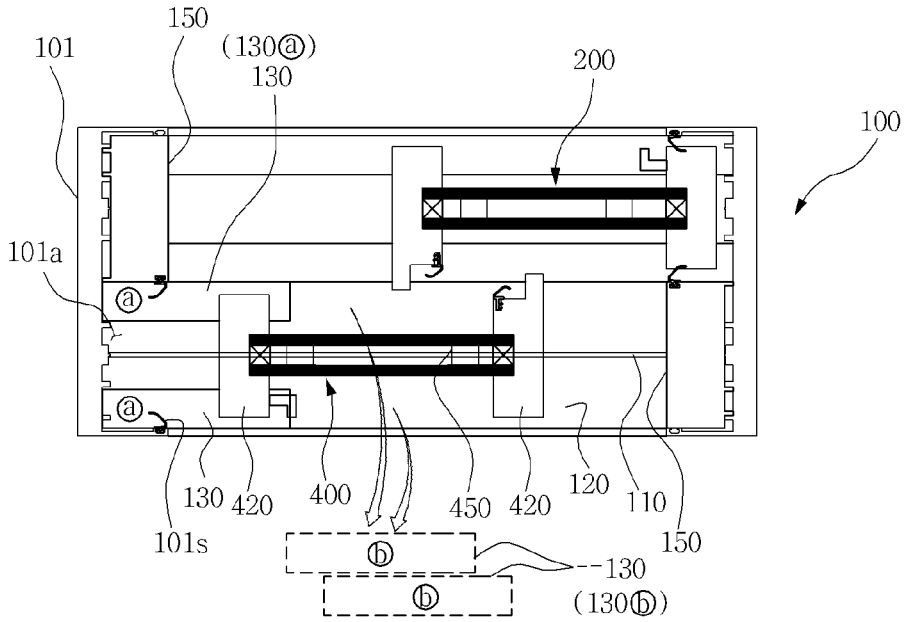
Figure 26:
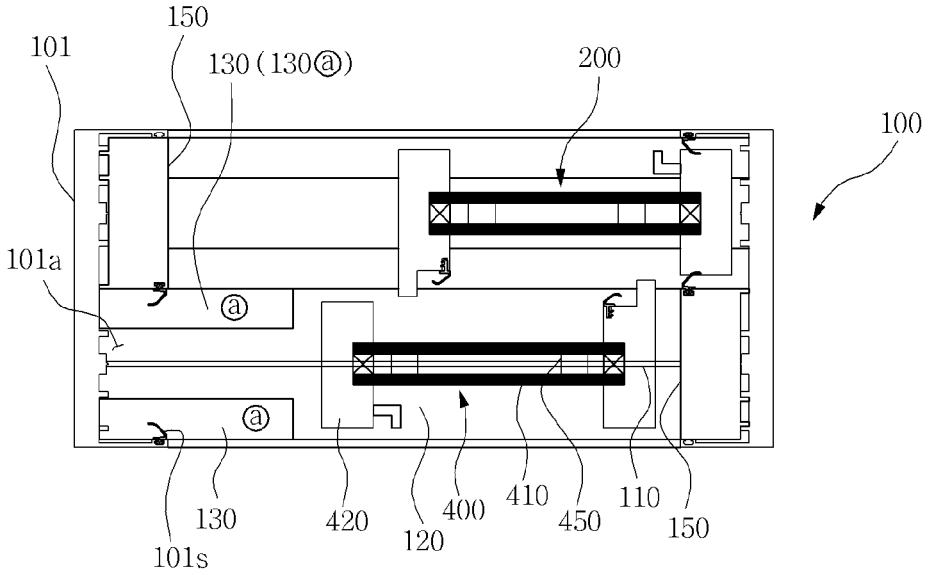

First, when the sliding window 400 is in the closed state as illustrated in FIG. 22, the sliding window 400 is in the state where it cannot be easily removed from the door guide frame 100 due to the interference between the pocket guide segments 130*a* and 130*b* provided as the pocket guides 130. However, the segment 130*c* located at a position where the sliding window 400 is not positioned as illustrated in FIG. 23 may be removed from the body 120 of the door guide frame 100. Then, when the sliding window 400 is slid to be partially opened as illustrated in FIG. 24 so that the sliding window 400 is positioned on the intermediate pocket guide segment 130*b*, since the pocket guide segment 130*b* has a length shorter than the interval between vertical stiffeners 420 positioned on the opposite side surfaces of the sliding window 400, the intermediate pocket guide segment 130*b* may also be removed from the body 120 of the door guide frame 100 without interference with the sliding window 400 as illustrated in FIG. 25. In the state illustrated in FIG. 26 in which two pocket guide segments 130*c* and 130*b* are removed from the body 120 of the door guide frame 100, the sliding window 400 may be removed from the door guide frame 100 without interference from the body 120 of the door guide frame 100 as described above with reference to FIGS. 16, 17 and 19. The state in which the sliding window 400 is removed is illustrated in FIG. 27.

Figure 27:
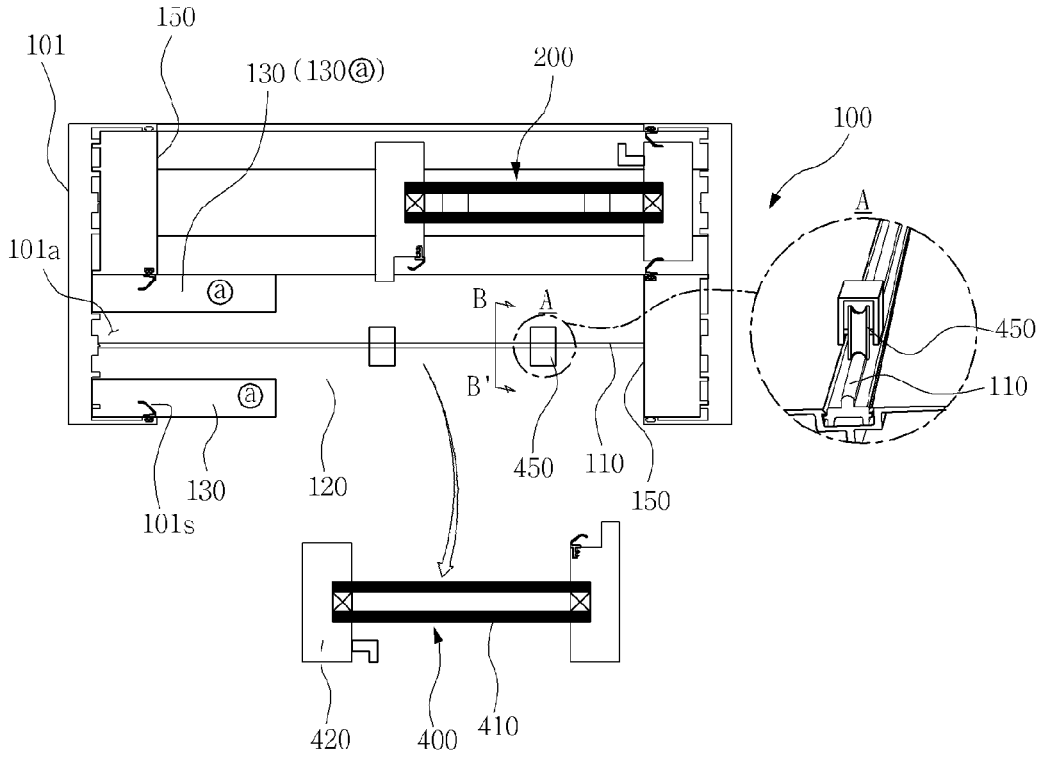

Meanwhile, the order performed from FIGS. 22 to 27 may be referred to as the steps of removing the sliding window 400 from the door guide frame 100 and on the contrary, the order performed from FIG. 27 to FIG. 22 may be referred to as the steps of installing the sliding window 400 in the door guide frame 100.

Figure 28:
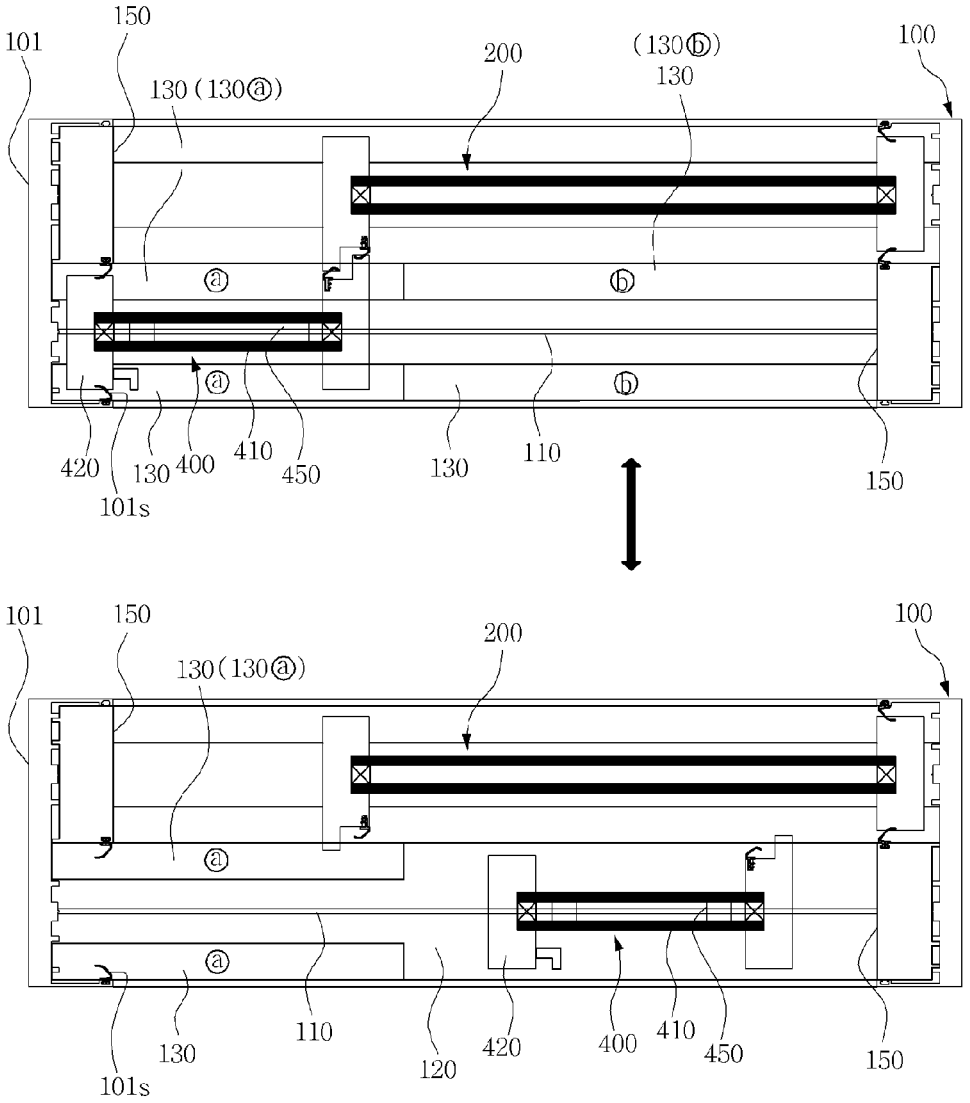
FIG. 28 is a plan view illustrating an operating state of an embodiment using pocket guide segments divided unlike the embodiment illustrated in FIGS. 22 to 27.

The embodiment described above exemplifies a case in which three pocket guide segments 130*a*, 130*b* and 130*c* are divisionally installed as the pocket guide 130 inside and outside of the sliding window 400 along the entire length of the roller guide rail 110. Unlike this, descriptions will be made in terms of removal and installation of a front sliding window assuming that a window denoted by reference numeral 200 in FIG. 28 is a fixed window having a width which is larger than the front sliding window 400. In this case, it can be seen that the present invention may be implemented by divisionally installing the pocket guide segments 130*a* and 130*b* having different lengths as the pocket guides 130. That is, in this case, the pocket guide segment 130*b* larger than the entire width of the sliding window 400 may be removed from the door guide frame 100 so that the sliding window 400 may be removed from the door guide frame 100 or installed in the door guide frame 100 without any difficulty.

Figure 29:
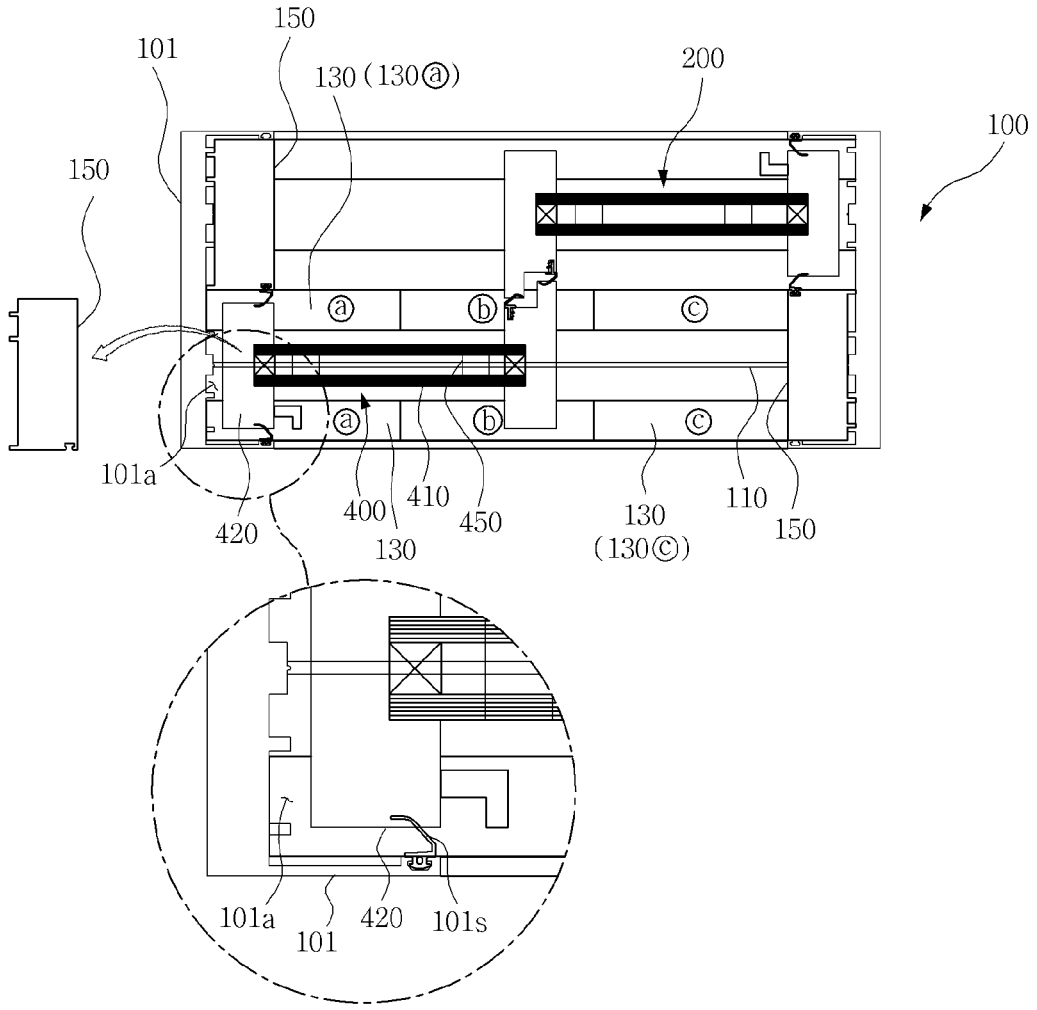
FIG. 29 is a plan view illustrating a plan view for describing an additional characteristic structure for improving heat insulation in the sliding window installation structure according to the present invention and an effect thereof.
Figure 30:
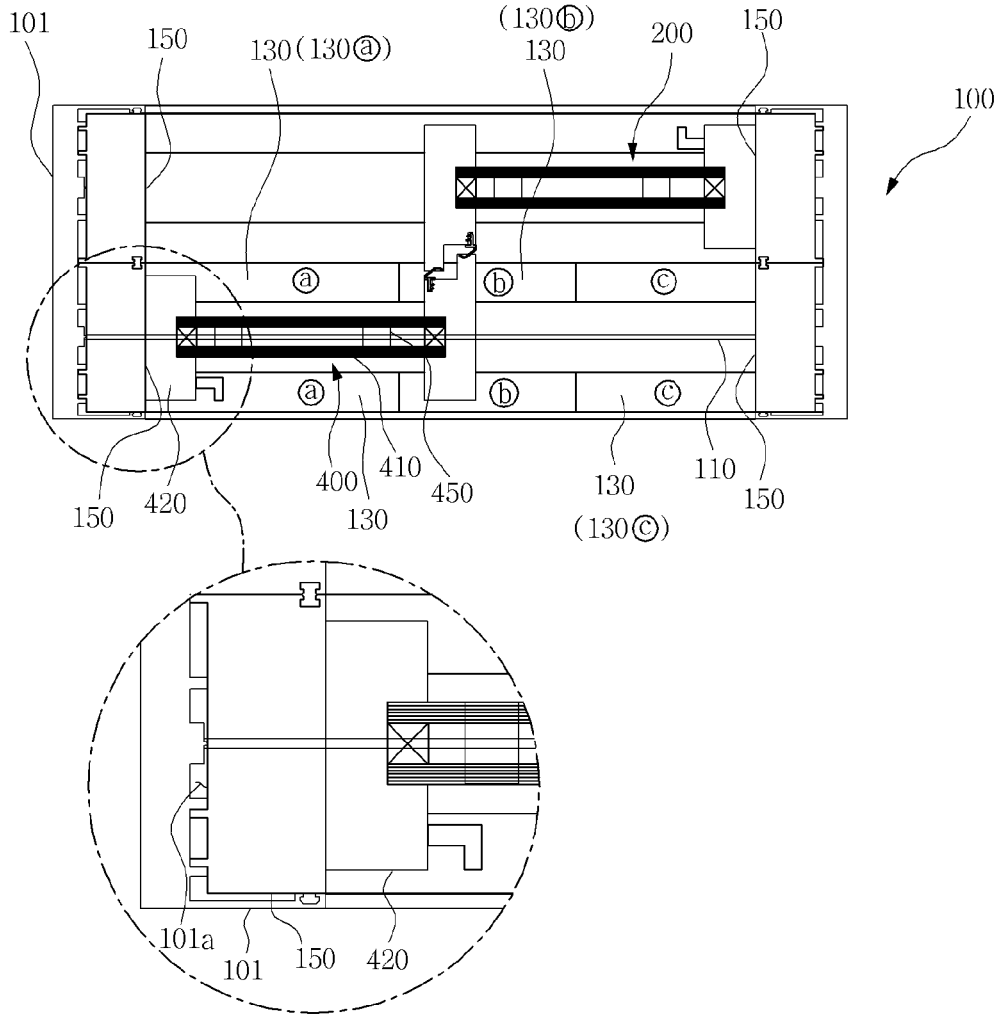
FIG. 30 is a plan view illustrating a comparative embodiment from which the characteristic structure is removed.

In addition, descriptions will be made on an additional embodiment in terms of improvements in window openness and heat insulation among the technical objects of the present invention with reference to FIGS. 29 and 30. FIG. 29 is a plan view illustrating an additional characteristic structure for improving heat insulation in the sliding window installation structure according to the present invention, and FIG. 30 is a plan view illustrating a comparative example in which the characteristic structure is removed.

First, the comparative embodiment illustrated in FIG. 30 will be described. When the sliding window 400 is closed, the vertical stiffener 420 constituting the sliding window 400 is exposed to the outside without entering the inside of the vertical guide frame 101 forming the door guide frame 100 constituting the window frame. As a result, the complete openness is hindered by the vertical stiffener 420, thereby disturbing an open view through the window, and heat insulation deteriorates.

On the contrary, in the additional embodiment of the present invention, when the sliding window 400 is closed, a vertical stiffener insertion channel 101*a* is provided inside of the vertical guide frame 101 forming the door guide frame 100 as illustrated in FIG. 29 so that the vertical stiffener 420 constituting the sliding window 400 is inserted into and concealed by the vertical guide frame 101 forming the door guide frame 100 constituting the window frame. A vertical elastic gasket 101*s* may be provided in the end of the vertical guide frame 101 provided with the vertical stiffener insertion channel 101*a* to hermetically block a gap between the vertical guide frame 101 and the vertical stiffener 420. With this structure, the vertical stiffener 420 is concealed not to hinder the complete openness of the window while improving heat insulation.

However, the vertical stiffener insertion channel 101*a* may be opened to the inside of the vertical guide frame 101 when configuring the sliding window system according to design requirements such as a position on a plane, the direction of closing the sliding window, the sizes of the sliding window and the window frame. Alternatively, some vertical stiffener insertion channels 101*a* may be selectively closed in advance by a blocking block 150 which is separately manufactured and assembled by being inserted into the vertical stiffener insertion channel 101*a* in the vertical direction.

Meanwhile, in the case of the lower pocket guides 130 according to the present invention, the width B2 of the opening between the lower pocket guides 130 installed inside and outside of the window to be removable from the door guide frame body 120 should have a range determined such that, even if the lower end of the glass panel 410 provided with the vertical stiffener 420 and the roller 450 are turned over, the location (reference numeral "k1" in FIG. 31), where the bottom surface of the lower end of the glass panel 410 and the top surface of the upper end of the roller 450 are in contact with each other to support the glass panel 410, shall not pass over the vertical center line C.L. of the lower roller guide rail 110.

Figure 31:
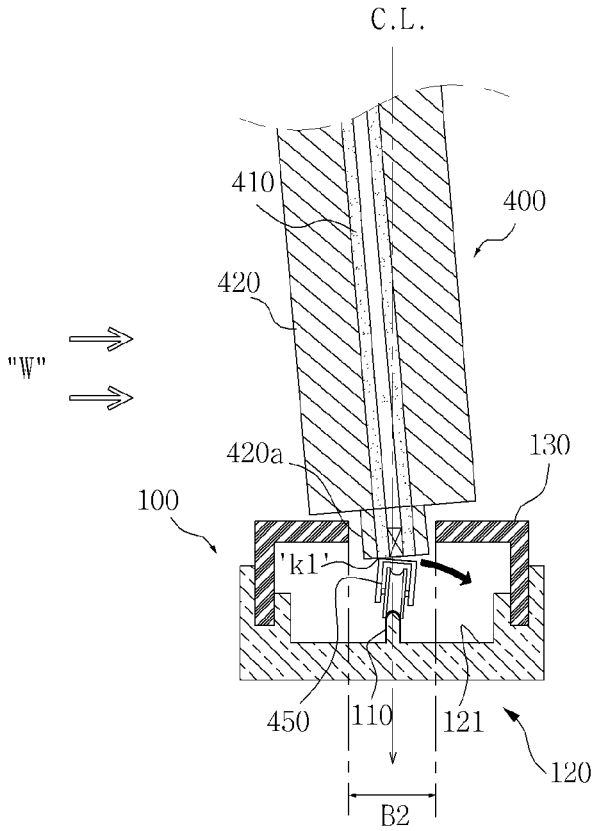
FIG. 31 is a view illustrating a preferable width of an opening between lower pocket guides according to the present invention.
Figure 32:
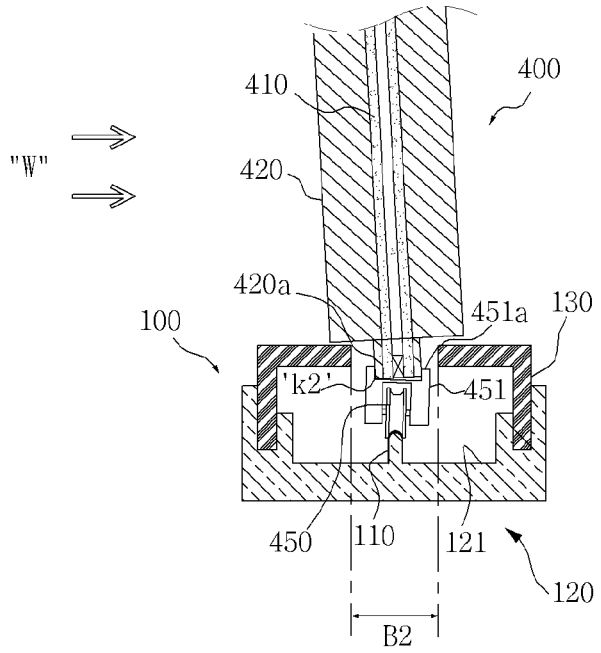
FIG. 32 illustrating an embodiment of the present invention in which support shoulders for supporting a lower end of a glass panel are formed on the upper end of a roller support bracket.

In addition, it may be considered that the location (reference numeral "k1" in FIG. 31), where the bottom surface of the lower end of the glass panel 410 and the top surface of the upper end of the roller 450 are in contact with each other to support the glass panel 410 as illustrated in FIG. 31, is slid on the top surface of the upper end of the roller 450. When such a phenomenon occurs, a satisfactory turnover prevention effect cannot be expected only with the above-described control of the width B2 of the opening of the lower pocket guide 130. Thus, in order to prevent the slippage of the location (reference numeral "k2" in FIG. 32), where the bottom surface of the lower end of the glass panel 410 and the top surface of the upper end of the roller 450 are in contact with each other to support the glass panel 410, support shoulders 451*a* for supporting the lower end of the glass panel may be provided on the upper end of the support bracket 451 of the roller 450 as illustrated in FIG. 32. The support shoulders 451*a* supporting the lower end of the glass panel are also presented in the first embodiment illustrated in FIGS. 16 and 17, and in the second example using the annular roller device 500 illustrated in FIGS. 18 to 21, the glass seat 510 provided for the same purpose as the support bracket 451 may also be provided with support shoulders 510*a* for supporting the lower end of the glass panel.

Meanwhile, the sliding window installation structure according to the present invention described up to now may be made of a synthetic resin such as PVC or an aluminum material. In particular, when the sliding window installation structure is made of the aluminum material, it will be more advantageous to adopt a structure in which the body 120 of the door guide frame 100 is formed to be divided into portions inside and outside of the window and a thermal break material 120*m* is interposed therebetween. In addition, the pocket guide 130 may also be formed such that a region 130*m* to be in contact with the thermal break material 120*m* of the door guide frame body 120 is formed of the thermal break material in separation of the remaining cap region 103*c*.

Figure 33:
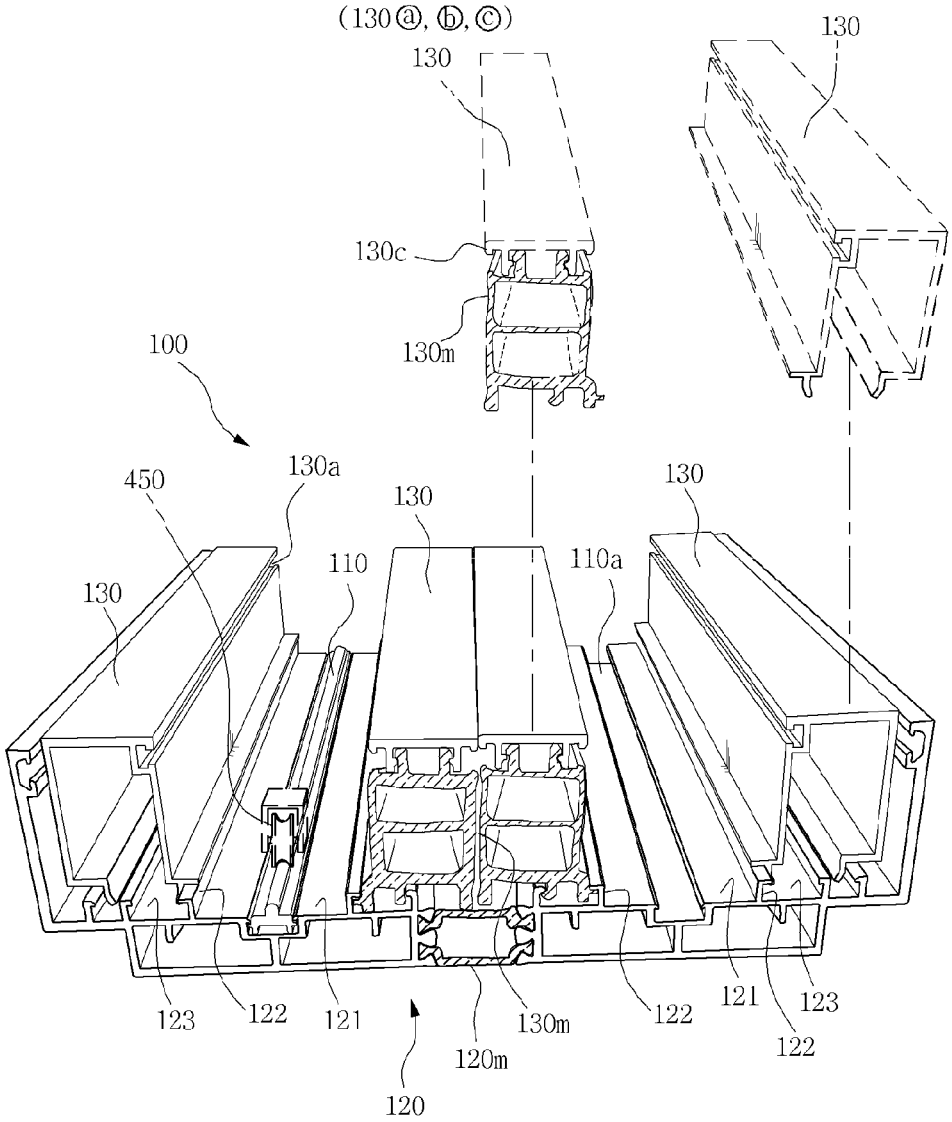
FIGS. 33 and 34 are perspective views illustrating an embodiment of the present invention to which the sliding window installation structure of the present invention is applied to an aluminum window frame system.
Figure 34:
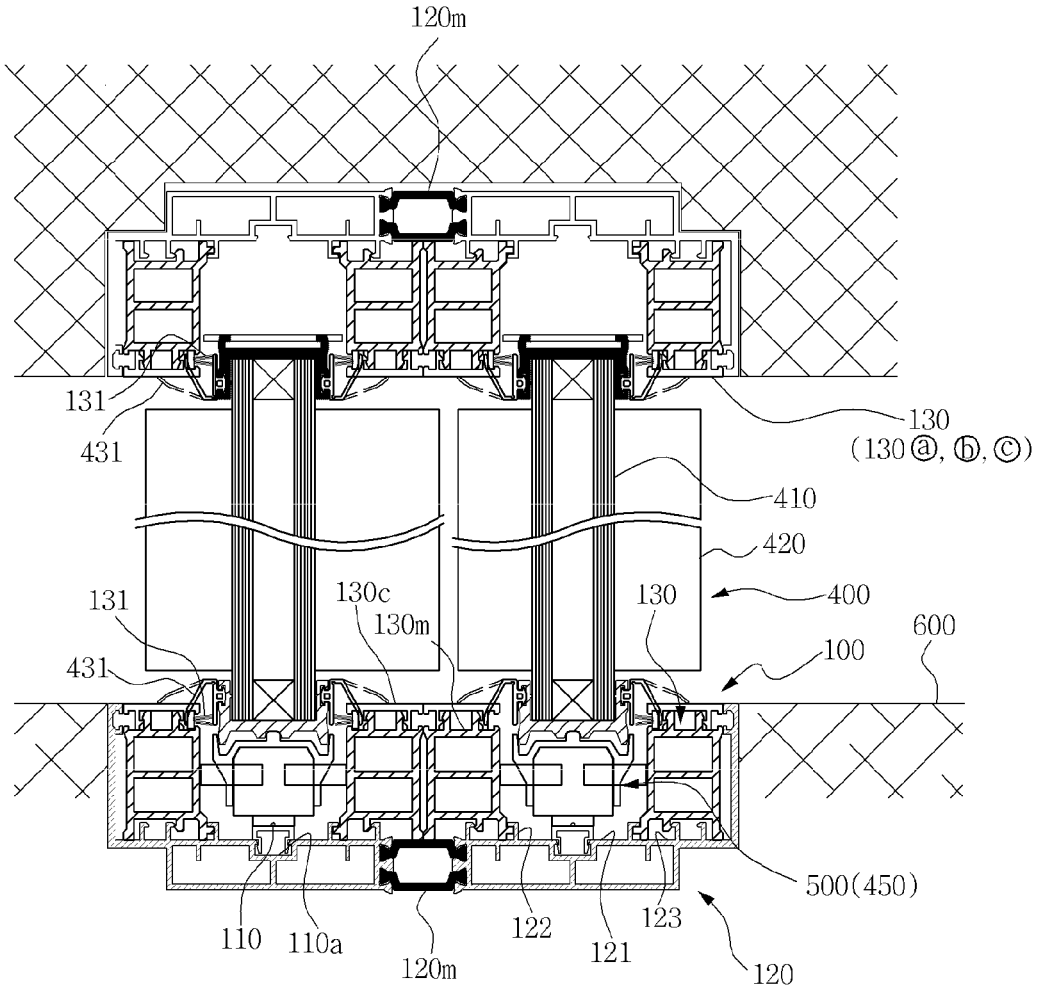

In addition, a rail installation recess 110*a* may be formed on the base surface 121 of the door guide frame 100 such that the roller guide rail 110 manufactured according to the size and type of the roller (the conventional roller 450 in FIG. 33 or the annular roller device 500 in FIG. 34) may be inserted and installed to be replaceable.

Figure 35:
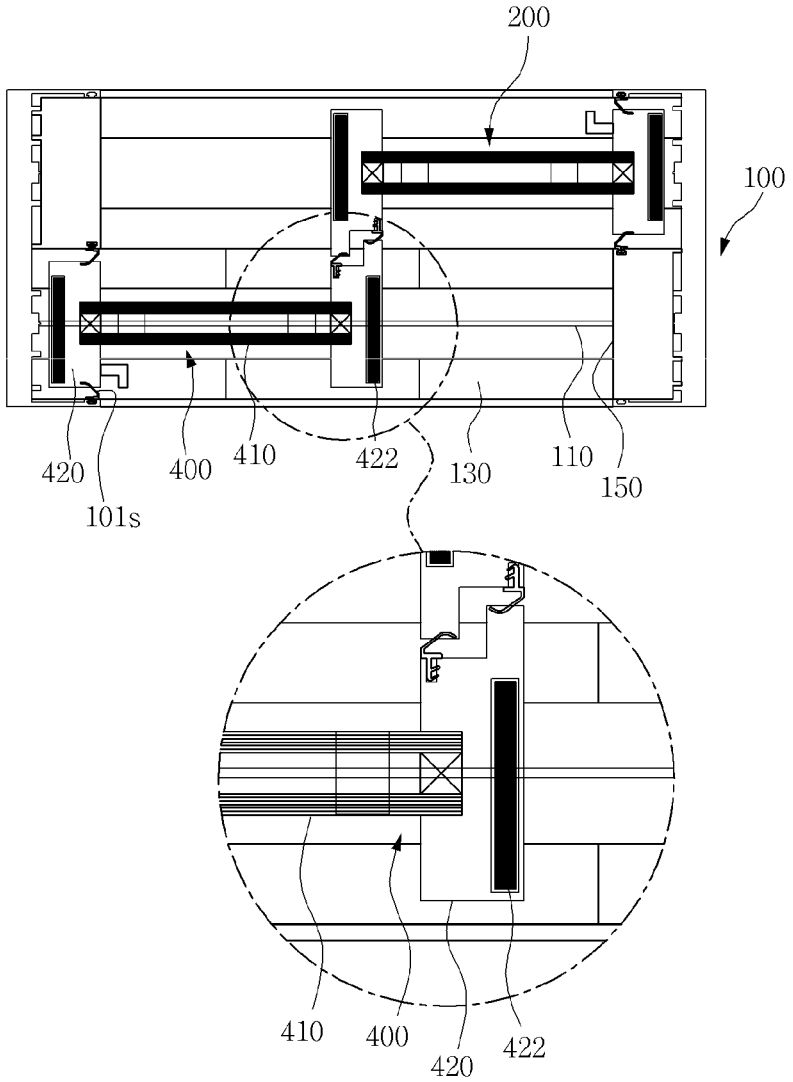
FIG. 35 is a view illustrating an embodiment in which a steel reinforcement plate in an insert form is inserted into a vertical stiffener.

In addition, when the synthetic resin such as PVC or aluminum is used as the material for the sliding window installation structure according to the present invention and the window is enlarged, the thickness of the vertical stiffeners 420 may be excessively thick due to the limit of rigidity of the material. In order to alleviate such a problem by providing high bending rigidity as compared to a cross-sectional size, a steel reinforcement plate 422 in an insert form may be inserted into the vertical stiffener 420 as illustrated in FIG. 35.

Figure 36:
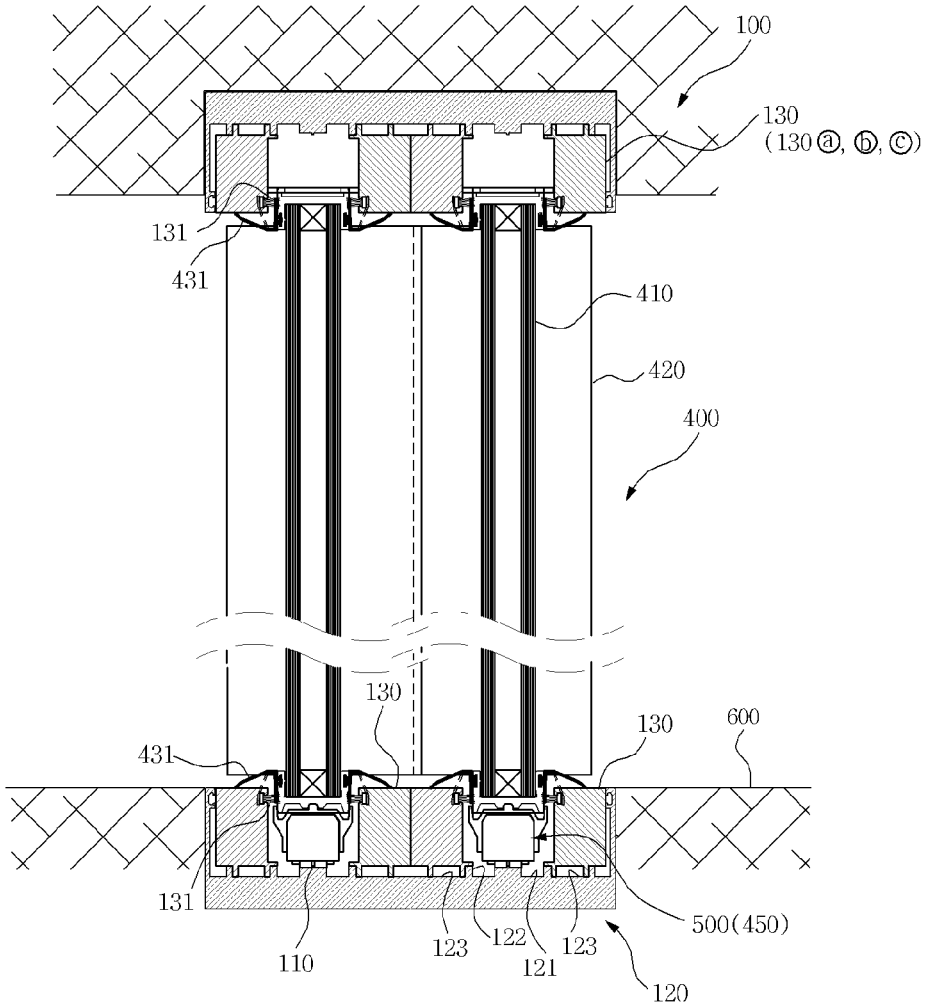
FIGS. 36 and 37 are views for describing an embodiment in which a lower structure of a door guide frame, in which pocket guide segments according to the present invention are removably installed in a door guide frame body, is embedded in a floor surface of a building.
Figure 37:
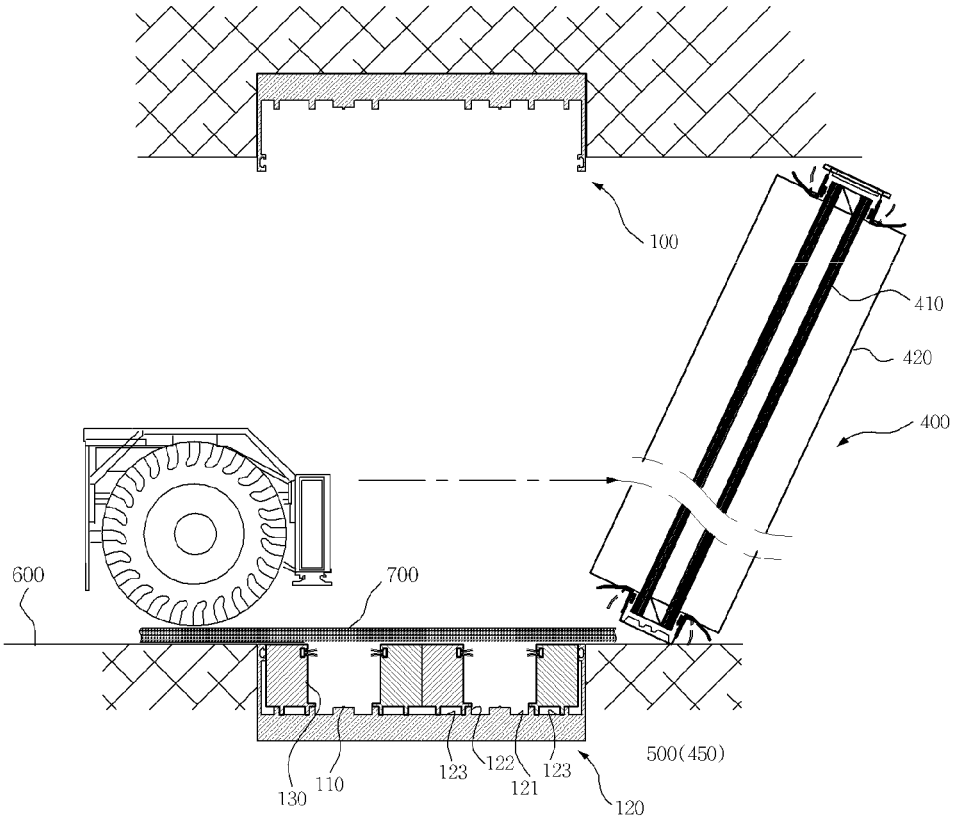

Meanwhile, as an embodiment provided in another point of view of the present invention, a sliding window installation structure using a sliding window system provided with a door guide frame 100 which may be embedded in the floor surface of a window installation structure may be provided as illustrated in FIGS. 36 and 37 in which a door guide frame 100, which is provided with removable pocket guides 130 divisionally installed as pocket guide segments, is embedded in a building floor surface 600. According to this structure, the view openness of the sliding window may increase as illustrated in FIG. 36. In addition, since the door guide frame 100 has a structure which does not protrude above the floor surface in the state where the pocket guide 130 constituting the upper structure of the window frame is separated from the door guide frame 100 as illustrated in FIG. 37 and then the sliding window 400 is removed (or opened) from the door guide frame 100, for example, wheels of a large truck may also pass over the door guide frame 100 without interference. Here, when it is difficult to support a passage weight only by the rigidity of the pocket guides 130 of the door guide frame 100, a separate cover plate 700 covering both the building floor surface 600 and the pocket guides 130 may be installed as illustrated in FIG. 37.

As described above, a window provided with a pair glass formed by mounting two glass panels 410 to overlap with each other with a gap therebetween and be spaced apart from each other and adhering the glass panels with a sealing member to form vacuum in the gap has been described in detail with reference to the drawings which illustrate the sliding windows 400 according to the embodiments of the present invention. However, the scope of the present invention to be protected is not limited thereto and may cover various types of sliding windows (door or window) to which the present invention is applied, and various modifications and changes using the basic concept of the present invention defined in the accompanying claims also belong to the scope of the present invention.

The invention claimed is:

1. A sliding window installation structure including a guide frame, including upper and lower guide frames, of a separable and removable segment structure, in which a glass panel forming a sliding window constituting a part of a sliding window system is removably seated on and supported by rollers without a separate sash that supports the glass panel, and an upper and a lower pocket guide are respectively formed in the upper and lower guide frames, forming a window frame member that guides and supports a smooth movement of the sliding window so as to guide an upper end and a lower end of the sliding window along an inner and an outer surface of the sliding window;

characterized in that vertical stiffeners with a first thickness on both inner and outer surfaces of the sliding window for the upper end and the lower end of the sliding window and with a second thickness for a center region between the upper end and the lower end of the sliding window are attached to both a left-side and a right-side of the glass pane that constitutes a part of the sliding window including the glass panel supported by the rollers so as to reinforce a transverse bending rigidity of the glass panel, wherein the second thickness is larger than the first thickness; and wherein in order to allow the sliding window provided with the vertical stiffeners to be integrally installed within the upper and lower guide frames, and to allow the sliding window provided with the vertical stiffeners to be separated from the upper and lower guide frames, said upper and lower pocket guides configured to guide and support the upper end and the lower end of the sliding window with an upper end and a lower end of the vertical stiffeners having the first thickness are installed to be separable from a guide frame body, wherein the guide frame body and said upper and lower pocket guides constitute the upper and lower guide frames, in a direction parallel to a travel direction of a roller guide rail installed on a base surface of the guide frame body including an opening having a size larger than the first thickness of the vertical stiffeners, in which said upper and lower pocket guides comprise a plurality of pocket guide segments removable from the guide frame body, and said pocket guide segments are successively installed to be separable from each other on said inner and outer surfaces of the sliding window along the travel direction of the roller guide rail.

2. The sliding window installation structure of claim 1, characterized in that said pocket guide segments provided for said upper and lower pocket guides inside and outside of the sliding window are provided in at least one of said upper and lower guide frames.

3. The sliding window installation structure of claim 2, characterized in that said pocket guide segments provided for said upper and lower pocket guides inside and outside of the sliding window are divisionally formed as two or more segments over an entire length of the roller guide rail, wherein one or more segments are formed to have a length removable from the guide frame body without receiving an interference of the sliding window which is installed to be seated on the rollers on the roller guide rail, and the length of said pocket guide segments is determined to be smaller than an inner gap between the vertical stiffeners attached to a left-side and a right-side of the sliding window.

4. The sliding window installation structure of claim 3, characterized in that in order to improve dust resistance, water-tightness, and air-tightness of the sliding window system, blocking members are installed in a horizontal longitudinal direction on opposing surfaces of said pocket guide segments provided for said upper and lower pocket guides and the sliding window.

5. The sliding window installation structure of claim 4, characterized in that elastic gaskets are provided for said blocking members, wherein each of the elastic gaskets includes a fixed end fixed to the sliding window and an elastically deformable end which is in contact with an opened surface of the pocket guide segments.

6. The sliding window installation structure of claim 1, characterized in that in order to removably install said upper and lower pocket guides on the base surface of the guide frame body, partition walls are formed inside of outer walls of the guide frame body to protrude along the travel direction of the roller guide rail on the base surface, in which the roller guide rail is provided on a central portion of the base surface, so that accommodation portions are formed between said outer walls of the guide frame body and said partition walls so as to accommodate said upper and lower pocket guides.

7. The sliding window installation structure of claim 1, characterized in that left and right vertical guide frames are further provided for being used as the window frame, and a vertical stiffener insertion channel is provided inside of the left and right vertical guide frames so that the vertical stiffeners are inserted therein and concealed when the sliding window is closed, and a vertical elastic gasket is provided in an end of the left and right vertical guide frames provided with the vertical stiffener insertion channel to hermetically block a gap between one of said vertical guide frame and the vertical stiffeners.

8. The sliding window installation structure of claim 1, characterized in that a width of an opening between said upper and lower pocket guides installed inside and outside of said sliding window in a lower structure of the window to be removable from the guide frame body is set to be in a range determined such that, even if a lower end of the glass panel provided with the vertical stiffeners are turned over on the rollers, a location, where a bottom surface of the lower end of the glass panel and a top surface of an upper end of the rollers are in contact with each other to support the glass panel, does not pass over a vertical center line (C.L.) of the roller guide rail in a lower structure of the window.

9. The sliding window installation structure as claimed in claim 1, characterized in that support shoulders for supporting a lower end of the glass panel are provided on an upper end of a support bracket of the rollers, in order to prevent slippage of a location where a bottom surface of the lower end of the glass panel and a top surface of an upper end of the rollers are in contact with each other to support the glass panel.

10. The sliding window installation structure of claim 1, characterized in that said rollers are comprised of an annular roller device provided for said sliding window that supports a bottom surface of a lower end of the glass panel and allows the glass panel to be slid along the roller guide rail, and in that said annular roller device includes: a glass seat formed by a support bracket on a top central portion to be capable of accommodating the lower end of the glass panel, weight support plates formed integrally by connecting partition walls formed by extending downwardly from the glass seat and including said roller guide rail formed along said travel direction around the weight support plates; and an annular rolling unit wound around a top surface and a bottom surface of the weight support plates and circular arc surfaces formed in the travel direction to interconnect the top surface and the bottom surface of the weight support plates, wherein said annular rolling unit comprises a plurality of rolling members, each of which is formed in a cylindrical shape laid in a transverse direction to be orthogonal to the travel direction and includes a guide recess formed on an outer circumferential surface thereof along the travel direction; and a plurality of chain link units configured to interconnect the plurality of rolling members such that the plurality of rolling members are evenly disposed in an annular shape on the top surface and the bottom surface of the vertical support plates and the circular are surfaces of the weight support plate to be spaced by a preset interval along the roller guide rail.

11. The sliding window installation structure of claim 10, characterized in that support shoulders for supporting the lower end of the glass panel are provided on the glass seat in order to prevent slippage of a location where the bottom surface of the lower end of the glass panel and a top surface of an upper end of the rollers are in contact with each other to support the glass panel.

12. The sliding window installation structure of claim 1, characterized in that the guide frame body is formed to be divided into portions inside and outside of the window and a thermal break material is interposed therebetween.

13. The sliding window installation structure of claim 1, characterized in that a rail installation recess is formed on the base surface of the guide frame body such that the roller guide rail manufactured according to a size and a type of the rollers is inserted and installed to be replaceable.

14. The sliding window installation structure of claim 1, characterized in that a steel reinforcement plate is inserted into each of the vertical stiffeners.

15. The sliding window installation structure of claim 1, characterized in that a lower structure of the guide frame, in which the pocket guide segments are removably installed in the guide frame body, is embedded in a floor surface of a building.

* * * * *